US011147724B2

(12) United States Patent
St.John et al.

(10) Patent No.: US 11,147,724 B2
(45) Date of Patent: Oct. 19, 2021

(54) PERSON SUPPORT APPARATUS BARRIER

(71) Applicant: Stryker Corporation, Kalamazoo, MI (US)

(72) Inventors: Connor Feldpausch St.John, Kalamazoo, MI (US); Krishna Sandeep Bhimavarapu, Kalamazoo, MI (US); William Dwight Childs, Plainwell, MI (US); Michael Harry Lau, Bristol, IN (US); Annie Désaulniers, Bothell, WA (US); Michael T. Brubaker, Portage, MI (US); Richard A. Derenne, Portage, MI (US); Justin Raymond, Portage, MI (US); Michael Joseph Hayes, Kalamazoo, MI (US); Jason John Connell, London (CA); Christopher Scott Jacob, London (CA)

(73) Assignee: Stryker Corporation, Kalamazoo, MI (US)

( * ) Notice: Subject to any disclaimer, the term of this patent is extended or adjusted under 35 U.S.C. 154(b) by 0 days.

(21) Appl. No.: 16/908,933

(22) Filed: Jun. 23, 2020

(65) Prior Publication Data

US 2020/0390624 A1 Dec. 17, 2020

Related U.S. Application Data

(63) Continuation of application No. 15/218,500, filed on Jul. 25, 2016, now Pat. No. 10,695,246.
(Continued)

(51) Int. Cl.
*A61G 7/05* (2006.01)

(52) U.S. Cl.
CPC ..... *A61G 7/0506* (2013.01); *A61G 7/0503* (2013.01); *A61G 7/0518* (2016.11);
(Continued)

(58) Field of Classification Search
CPC .. A61G 7/0506; A61G 7/0507; A61G 7/0524; A61G 7/0518; A61G 7/05
See application file for complete search history.

(56) References Cited

U.S. PATENT DOCUMENTS 6,208,250 B1 * 3/2001 Dixon ..... A61G 7/05 340/539.12
6,320,510 B2 11/2001 Menkedick et al.
(Continued)

FOREIGN PATENT DOCUMENTS

AU 2010202928 A1 1/2011
DE 202008011412 U1 11/2008
(Continued)

OTHER PUBLICATIONS

CHG Hospital Beds, 1-70-007-A User Manual—Spirit Select—Ref 5700.
(Continued)

*Primary Examiner* — Fredrick C Conley
(74) *Attorney, Agent, or Firm* — Warner Norcross + Judd LLP

(57) ABSTRACT

A person support apparatus includes a base, a controller, and a barrier having at least one electrical device. The base includes mounting structures for releasably mounting the barrier to the base. A first electrical connector is in communication with the at least one electrical device and mounted to the barrier. A second electrical connector is in communication with the controller and mounted at one of the mounting structures for connection with the first electrical connector when the barrier is mounted to the base at the mounting structures.

13 Claims, 26 Drawing Sheets

Related U.S. Application Data

(60) Provisional application No. 62/197,715, filed on Jul. 28, 2015.

(52) U.S. Cl.
CPC ..... *A61G 7/0524* (2016.11); *A61G 2203/20* (2013.01); *A61G 2203/32* (2013.01); *A61G 2203/40* (2013.01); *A61G 2203/44* (2013.01)

(56) References Cited

U.S. PATENT DOCUMENTS

| | | | | |
|---|---|---|---|---|
| 7,986,242 | B2 | 7/2011 | Dixon et al. | |
| 8,864,205 | B2 | 10/2014 | Lemire et al. | |
| 9,306,322 | B2 | 4/2016 | Bhimavarapu et al. | |
| 9,655,457 | B2 | 5/2017 | Meyer et al. | |
| 2001/0001235 | A1 | 5/2001 | Menkedick et al. | |
| 2005/0166324 | A1 | 8/2005 | Dixon et al. | |
| 2006/0031989 | A1 | 2/2006 | Graham et al. | |
| 2006/0162068 | A1* | 7/2006 | Risk, Jr. ..... | A61G 7/0536 5/53.1 |
| 2007/0157385 | A1* | 7/2007 | Lemire ..... | A61G 7/0509 5/600 |
| 2011/0162142 | A1 | 7/2011 | Hakamiun et al. | |
| 2011/0214234 | A1 | 9/2011 | Herman | |
| 2011/0248672 | A1* | 10/2011 | Herman ..... | A61G 7/0507 320/108 |
| 2015/0115638 | A1 | 4/2015 | Lambarth et al. | |
| 2016/0013837 | A1 | 1/2016 | Howell et al. | |

FOREIGN PATENT DOCUMENTS

| | | | |
|---|---|---|---|
| WO | 2012135118 | A1 | 10/2012 |
| WO | 2015032003 | A1 | 3/2015 |

OTHER PUBLICATIONS

European Search Report for EP16181515, the European counterpart to U.S. Appl. No. 15/218,500.

* cited by examiner

PERSON SUPPORT APPARATUS BARRIER

This application is continuation of U.S. patent application Ser. No. 15/218,500, filed on Jul. 25, 2016, by inventor Connor Feldpausch St. John and entitled PERSON SUPPORT APPARATUS BARRIER, which claims the benefit of U.S. provisional patent application Ser. No. 62/197,715 filed Jul. 28, 2015, by inventor Connor Feldpausch St. John and entitled PERSON SUPPORT APPARATUS BARRIER, the disclosure of which are incorporated herein by reference in their entireties.

TECHNICAL FIELD

The present disclosure generally relates to a barrier, such as a footboard, for a person support apparatus, such as a hospital bed.

BACKGROUND

To provide access to the mattress, for example for cleaning or changing bed sheets, or to provide access to persons supported on a mattress, footboards have been configured so that they are removable. However, when a footboard is removed, the bed sheets may get in the way and form an obstruction over the footboard mounting structures, which can make it more difficult for a caregiver to replace the footboard. Further, many footboards include electrical connections to provide electrical connections between the electrical devices within the footboard and the bed-based control system. These connections may be vulnerable to damage if the footboard is not properly aligned. In addition, because electrical connectors are exposed once the footboard is removed, electrical connectors may be vulnerable to static electricity that can be generated, for example, when changing a sheet or when transferring a person off the bed.

SUMMARY OF THE DESCRIPTION

In one embodiment, a person support apparatus includes a base, such as a bed frame, a control system, and a barrier having an electrical device. The base and barrier include mounting structures for releasably mounting the barrier to the base. The person support apparatus further includes first and second electrical connectors. The first electrical connector is in communication with the electrical device and is mounted to the barrier, and the second electrical connector is in communication with the bed-based control system and mounted at one of the mounting structures for connection with the first electrical connector when the barrier is mounted to the base at the mounting structures.

In one aspect, the mounting structures comprise posts extending from or sockets in the base. Optionally, the second electrical connector is moveable at one of the posts or in one of the sockets. Further, the one of the posts or sockets optionally have a chamfered edge to reduce load on the second electrical connector.

In another aspect, the barrier includes sockets for receiving the mounting structures.

In a further aspect, the first electrical connector is recessed in one of the sockets, and optionally one of the electrical connectors is movably mounted.

In any of the above, the apparatus further includes a locking assembly for locking the barrier to the base when the barrier is mounted to the base at the mounting structures. Optionally the locking assembly includes a manually operable actuator. For example, the manually operable actuator may comprise a movable handle, such as a rotatable handle, mounted in the barrier.

In another aspect, the locking assembly includes a pair of engagement structures, with each engagement structure configured to engage the mounting barrier when the barrier is mounted to the base at the mounting structures, and further located in the mounting structures.

According to yet another aspect, the locking assembly includes a pair of engagement structures, such as cams. The engagement structures are operable to selectively engage the mounting structures to thereby lock the barrier to the base when the barrier is mounted to the base at the mounting structures, and with the engagement structures being located in the barrier.

In any of the above, the second electrical connector is recessed within the one of the mounting structures.

In any of the above, the apparatus may also include a deck supported by the base. The deck has an upper surface for supporting a mattress thereon. And, the first electrical connector is located at an elevation higher than a mattress supported on the deck.

In other aspects, the sockets include projecting cylinders for extending into the mounting structures, and with one of the projecting cylinders optionally supporting the first electrical connector.

In a further aspect, the apparatus also includes a locking assembly with engagement structures for engaging the mounting structures.

In yet another aspect, the mounting structures comprise cylindrical members, with each cylindrical member having a detent. The engagement structures are operable to engage the detents to thereby lock the barrier to the base when the barrier is mounted at the mounting structures.

According to yet another embodiment, a person support apparatus includes a base, such as a bed frame, a barrier, and a locking assembly. The base includes mounting structures for releasably mounting the barrier to the base. And, the locking assembly locks the barrier to the base when the barrier is mounted to the base at the mounting structures. The barrier stays in a substantially upright position when the locking assembly has locked the barrier to the base.

For example, the mounting structures may comprise posts.

In any of the above, the barrier includes sockets for receiving the mounting structures.

In another aspect, the locking assembly includes a manually operable actuator, such as a movable handle, including a rotatable handle, mounted in the barrier.

According to yet another aspect, the actuator is only operable if the barrier is in the correct position or when no obstruction is present.

In any of the above, the locking assembly includes a pair of engagement structures, with each engagement structure configured to engage the mounting barrier, when the barrier is mounted to the base at the mounting structures, and located in the mounting structures.

In any of the above, the locking assembly includes engagement structures, such as cams, which are operable to selectively engage the mounting structures to thereby lock the barrier to the base when the barrier is mounted to the base at the mounting structures, and which are located in the barrier.

In one aspect, the locking assembly includes a movable handle that is configured to move the engagement structures between a first position and a second position. When in the first position, the engagement structures are operable to engage the barrier, and when in the second position, the engagement structures are disengaged from the barrier.

Optionally, the engagement structures comprise elongated members joined by a link.

In another aspect, the movable handle is configured to rotate the engagement structures between a first position and a second position. When in the first position, the engagement structures are operable to engage the mounting structures. When in the second position, the engagement structures are disengaged from the mounting structures.

For example, in one embodiment, the engagement structures comprise cams, with the movable handle configured to pivot the cams between the first and second positions.

In addition, springs may be provided, which bias the cams in their first position.

Optionally, the apparatus includes links that couple the cams to the movable handle. The links are coupled to the cams in slotted openings to allow the cams to pivot relative to the links when moving between their first position and their second position.

In yet other aspects, each of the engagement structures includes a pair of spaced apart fingers for engaging the mounting structures. Optionally, the mounting structures may include a pair of spaced apart fingers engaging the engagement structures.

According to yet another embodiment, a person support apparatus includes a frame having a location, a barrier movably mounted at the location at the frame; and an electrical device mounted at the location independent of the barrier. The barrier may be removed from the frame without removing the electrical device.

In one aspect, the electrical device includes a device selected from the group consisting of a display, an electrical outlet, a pneumatic port, and a sensor, such as a load cell.

In a further aspect, the electrical device comprises a display.

Optionally, the apparatus further includes a pedestal mounted at the location, with a display mounted to the pedestal.

In one aspect, the pedestal is movably mounted at the location, and optionally pivotally mounted at the location.

According to yet other aspects, a controller is mounted at the person support apparatus, wherein the display is in communication with the controller. Optionally, the display is in communication with the controller through a wired or wireless datalink.

In another aspect, the barrier includes a recess for receiving the pedestal when the barrier is mounted to the frame at the location. For example, the recess is configured to allow access to the display when the barrier is at the location.

In other aspects, the barrier is pivotally mounted to the frame at the location. Optionally, the barrier is removably mounted to the frame at the location.

In any of the above, the barrier optionally straddles the electronic device.

In any of the above, the pedestal optionally includes a mount for an accessory selected from the group consisting of a tray, a pump, and an IV bottle. In one embodiment, the pedestal includes a mount for a tray, and optionally with the tray being removably mounted to the pedestal.

In any of the above, the barrier optionally comprises a footboard. Optionally, the footboard may comprise a shell.

In yet another embodiment, a person support apparatus includes a bed frame, a footboard mounted at the bed frame, and an electrical connection provided at the footboard through the bed frame. The footboard is mounted for movement between an operative position wherein the footboard forms a barrier and a stowed position wherein the electrical connection through the bed frame remains connected.

In one aspect, the footboard is pivotally mounted at the bed frame. For example, the footboard may pivot downwardly when moved to its stowed position.

In another aspect, the apparatus optionally further includes a pedestal, with the pedestal located with the footboard at the bed frame. Further, the electrical connection is optionally provided in the pedestal.

In yet a further aspect, the pedestal remains stationary when the footboard is moved to the stowed position.

Before the embodiments are explained in detail, it is to be understood that the disclosure is not limited to the details of operation or to the details of construction and the arrangement of the components set forth in the following description or illustrated in the drawings. The disclosure may be implemented in various other embodiments and is capable of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the disclosure to any specific order or number of components. Nor should the use of enumeration be construed as excluding from the scope of the disclosure any additional steps or components that might be combined with or into the enumerated steps or components.

These and other advantages and features of the invention will be more fully understood and appreciated by reference to the description of the current embodiment and the drawings.

DESCRIPTION

Figure 1:
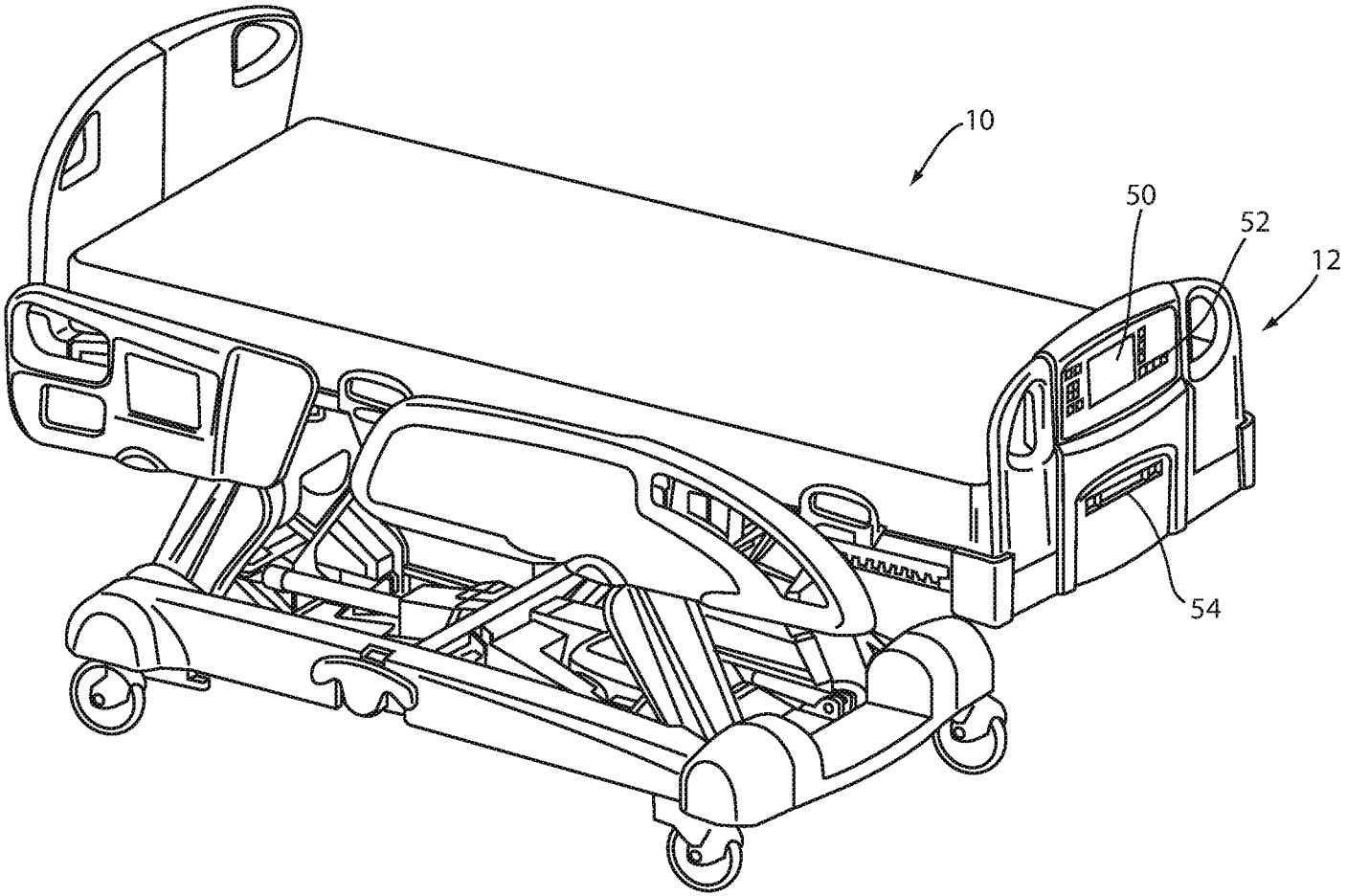
FIG. 1 is a perspective view of a person support apparatus.

Referring to FIG. 1, the numeral 10 generally designates a person support apparatus. As will be more fully described below, person support apparatus 10 includes a removable footboard 12 that mounts to a bed using mounting structures 15 that reduce the chances of an obstruction from a bed sheet.

Figure 2:
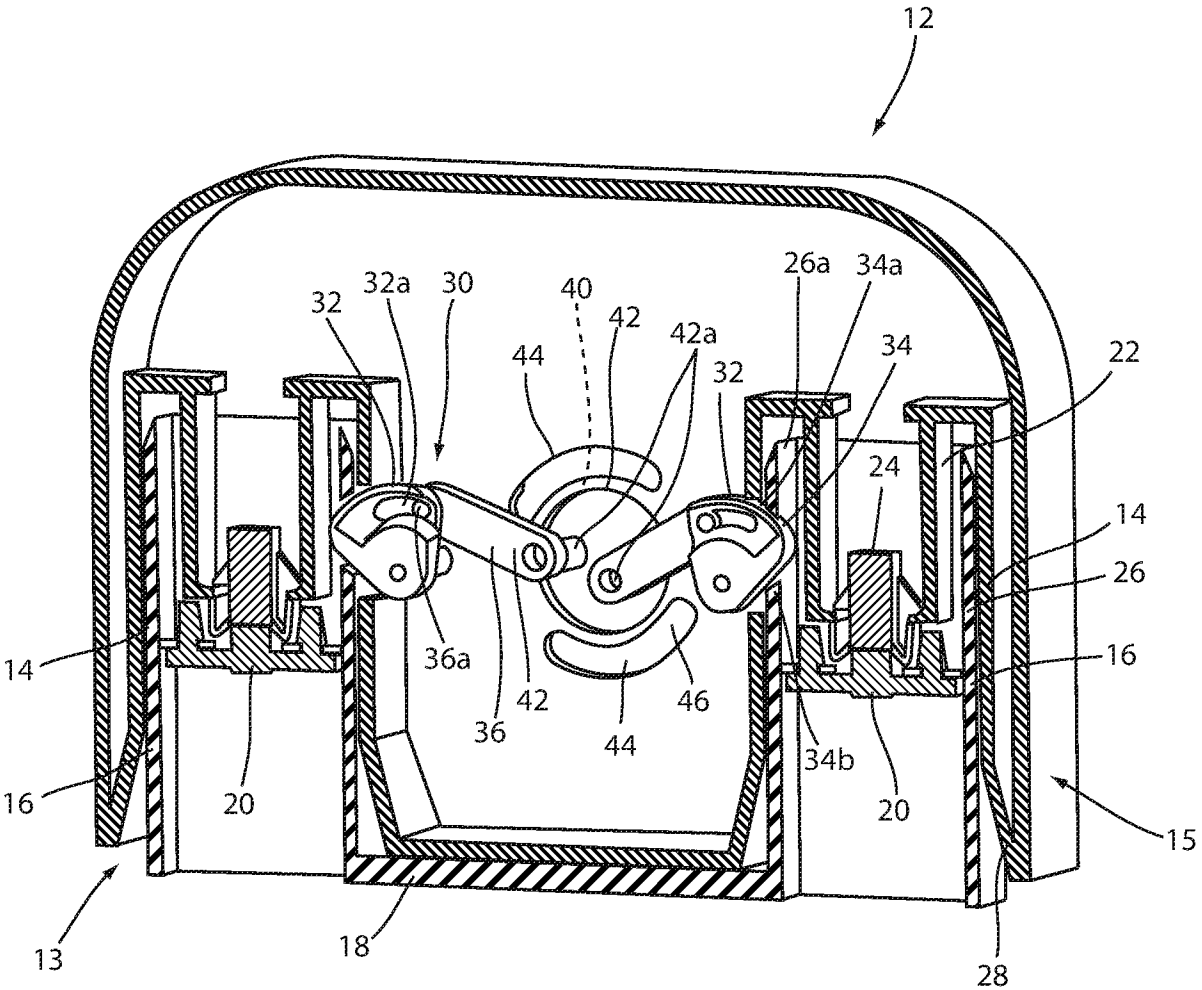
FIG. 2 is a fragmentary view of a footboard of a person support apparatus.

Referring to FIG. 2, footboard 12 includes a pair of sockets or receptacles 14 that are configured to receive corresponding posts 16 formed or provided on bed frame 18, which form the mounting structures 15. In the illustrated embodiment, the posts are formed on or provided on a footboard mounting base 13 that is mounted to the bed frame 18 at the foot end of the bed. To provide electrical connection between electrical devices located in the footboard and the control system of the bed, located in each post is an electrical connector 20, which is electrically coupled to the bed-based control system (not shown). Located in each socket 14 is a downwardly depending post 22 that supports another electrical connector 24, which is electrically coupled to one or more electrical devices housed within footboard 12. As will be more fully described below, only when footboard 12 is properly aligned with and at least partially mounted on posts 16, will electrical connectors 20 and 24 make contact to provide electrical communication between one or more electrical devices in footboard 12 and the bed-based control system, which can reduce the likelihood of damaging the connector pins on the respective electrical connections. This is achieved by providing at least one floating electrical connector.

In addition, because the protruding nature of the post, the footboard mounting assembly provides an obstruction indicator that is readily apparent to a caregiver when a bed sheet is creating an obstruction, which will encourage the caregiver to clear the bed sheet from the posts before placing the footboard.

Electrical connector 20 is rigidly mounted either on the distal end of post 16 or recessed inside of post 16. The adjoining electrical connector 24 is loosely mounting within footboard 12 allowing it to "float" and move side-to-side as the footboard is loaded. This reduces the mechanical load on the electrical pins and connector, and allows the load to be taken up by the rigid post. Conversely, electrical connector 20 may be loosely mounted onto post 16 in addition to, or instead of, connector 24 in order to reduce the effects of mechanical loading on the electrical pins and connector.

In the illustrated embodiment, posts 16 each comprise a hollow, cylindrical body 26 with a chamfered end 26*a*, which helps facilitate the guiding of footboard 12 onto the respective posts. Similarly, each socket 14 may include a chamfered perimeter at or near its opening at its end 28 so the respective chamfered portions of the posts and the sockets will cooperate to facilitate alignment of the footboard 12 onto the mounting posts 16.

To lock footboard 12 in position on the respective posts, footboard 12 includes a locking mechanism 30 that mechanically interacts with the respective posts to thereby lock footboard 12 in position on the respective posts 16. Optionally, the locking mechanism is configured to provide a one-handed locking arrangement so that a caregiver can simply align the footboard with the posts and lower it onto the posts and thereby lock it. Similarly, the locking mechanism may be configured to allow a caregiver to pull on the footboard, which unlocks the footboard when a sufficient force is applied.

In the illustrated embodiment, locking mechanism 30 includes a pair of articulable locking members 32 that are moved into and out of engagement with the respective posts 16. Furthermore, in the illustrated embodiment, the articulable locking members 32 are formed from cams that are pivotally mounted to move between a locked position where they engage openings 34 provided in the respective posts 16 and an unlocked position where they are out of engagement with the openings, which as noted above can be done by simply pulling on the footboard. Further, the locking members are biased on their locked positions by springs (not shown). In this manner, when locking members 32 are aligned with openings 34, they will move into their engaged and locked positions.

Locking members 32 are selectively moved between their locked position (FIG. 2) and their unlocked positions by links 36. Links 36 are each pivotally mounted on one end to a respective locking member 32 and pivotally mounted on their opposed end to a handle, such as a rotatable handle, mounted to the exterior surface of the headboard (see FIG. 3). As best seen in FIG. 2, locking members 32 are coupled to links 36 by pins 36*a*, which are guided along slotted grooves 32*a* formed in locking members 32. This allows locking members 32 to move out of engagement when sufficient lifting force is applied to the footboard 12. Further, this allows the handle to be positioned in its locking position, before footboard is mounted to the posts, and only when locking members 32 are aligned with openings 34 does the locking mechanism lock the footboard in position. Optionally, locking members 32 may be shaped and/or the springs sized so that the force to release the footboard is a specified minimum value to ensure that the footboard is not inadvertently unlocked.

Additionally, the springs that bias the locking members 32 in their locked positions may generate a sufficient downward force on the post to urge footboard 12 toward the bed frame allowing a tighter fit.

To facilitate the locking and unlocking of the locking mechanism, openings 34 may include chamfered upper and lower surfaces 34*a*, 34*b*, which cooperate with the cam shape of locking members 32 to further facilitate the removal of the footboard.

As will be understood from FIG. 2, locking members 32 may be unlocked by the counterclockwise motion of the handle 40, which counterclockwise motion causes the links 36 to pull on the respective locking members 32 and cause them each to rotate inwardly. At the same time, the combination of the springs and slotted grooves 32*a* allow the locking mechanism to reset themselves when the footboard is removed. An example of a suitable rotatable handle is shown in FIG. 3.

Figure 3:
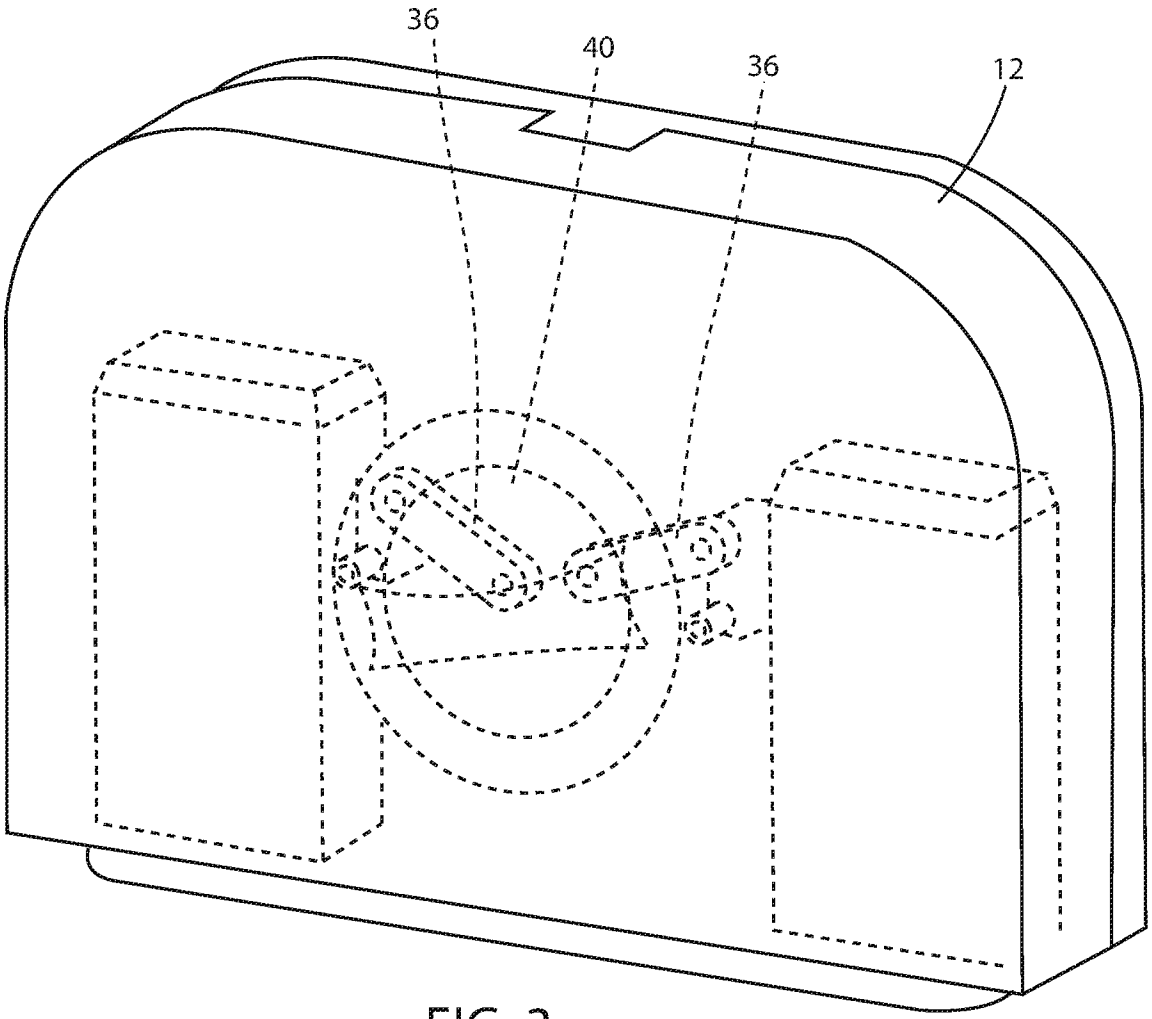
FIG. 3 is an elevation view of the footboard of FIG. 2.

Referring to FIGS. 2-3, handle 40 includes a central disk 42 which extends into the footboard 12 and includes a pair of posts 42*a* for pivotally mounting links 36 to disk 42 and thereby provide a pivotal coupling between the links and the rotating disk 42 of handle 40. Spaced radially outward from central disk 42 is a pair of arcuate groves 44 formed in the housing wall with guide stops 46 provided on disk 42 to thereby define and limit the position of the handle between unlocked and locked positions.

As previously noted, electrical connectors 20 and 24 are located within posts 16 and within sockets 14. Additionally, electrical connectors 20 and 24 are located such that they do not make contact until after each respective socket is at least partially mounted onto the respective post. As previously noted, this reduces the chance or possibility of damage to the respective connector pins. Additionally, one or both of the respective connectors may be mounted with a floating connection within their respective posts or sockets to further reduce the possibility of damage to the respective connectors. The height of the respective connectors may be varied. For example, the connectors may be elevated above the mattress supported on the person support.

As noted above, footboard 12 may include one or more electrical devices with which the electrical connectors are in electrical communication so that they are powered from the bed-based control system. For example, the electrical devices may comprise a display 50, such as a touchscreen, user inputs, such as buttons 52, or one or more lights 54.

Figure 4:
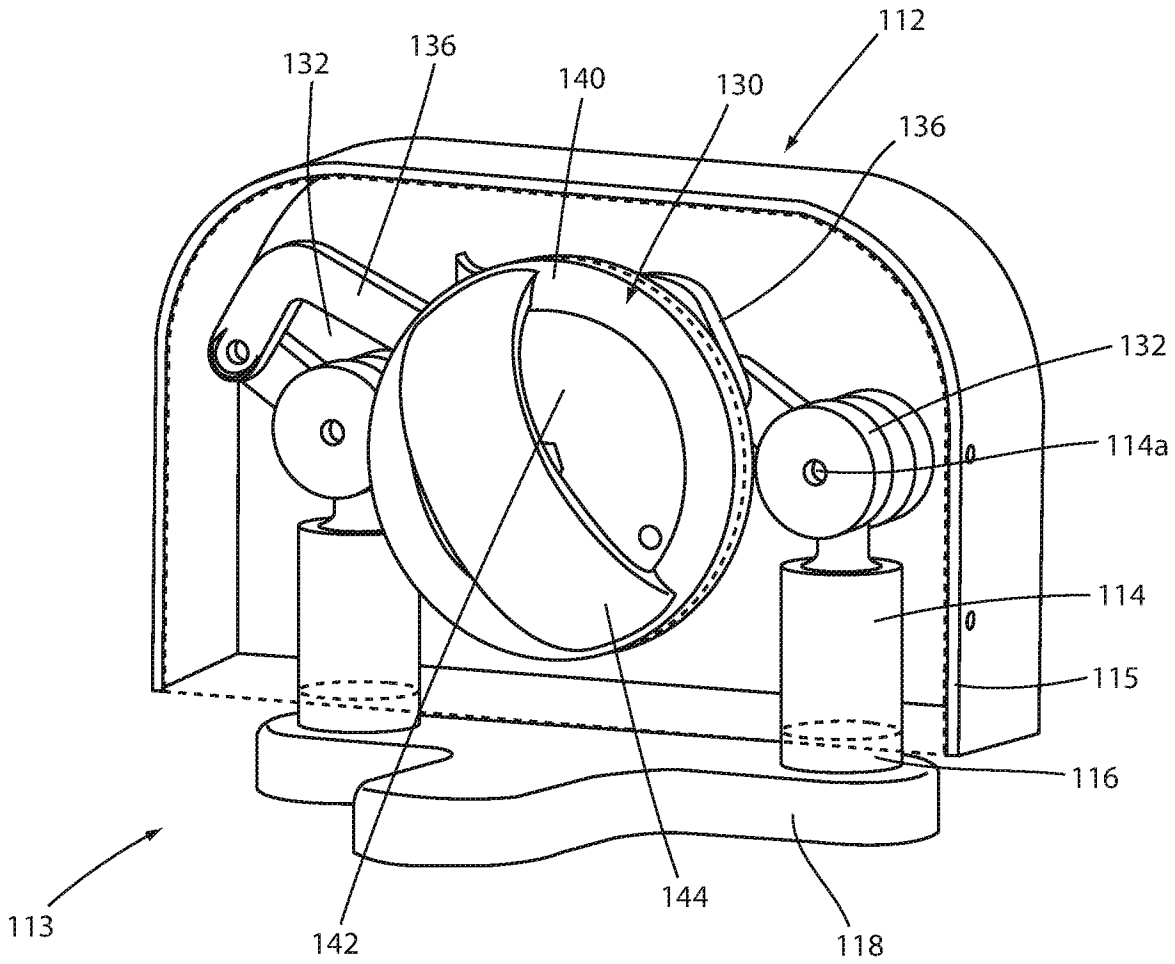
FIG. 4 is a fragmentary perspective view of another embodiment of a footboard mounting arrangement.

Referring to FIG. 4, the numeral 112 generally designates another embodiment of a footboard. Similar to footboard 12, footboard 112 includes a mounting structure 115 that reduces the chances of an obstruction from, for example, a bed sheet. In addition, the mounting structure is configured to reduce the possibility of damage to the electrical connectors in the footboard and in the bed frame, which may be provided within the mounting structures.

As best seen in FIG. 4, footboard 112 includes a pair of sockets 114 that mount to a pair of posts 116 formed on or that extend upwardly from base frame 118, for example, from a footboard mounting base 113, which is mounted to or forms part of the bed frame 118. Similar to the previous embodiment, the electrical connectors are mounted internally within the posts and sockets such that the posts and sockets make contact with each other prior to the connection between the respective electrical connectors. For further details of exemplary electrical connectors and their locations within the mounting mechanisms, reference is made to the first embodiment.

Footboard 112 includes another embodiment of a locking mechanism 130, which is adapted to lock footboard 112 onto the base frame via posts 116, as well as to apply a pulling force on the posts to thereby pull the footboard toward the frame to provide a tighter fit. As best understood from FIG. 4, locking mechanism 130 includes a pair of cams 132 that are configured to engage the tips of posts 116, which project through sockets 114. Cams 132 are pivotally mounted to the upper end of sockets 114 by pins 114*a* and are pivoted by a pair of lever arms 136. Lever arms 136 are each pivotally coupled on one end to cams 132 and pivotally coupled to a rotating handle 140 at their opposed ends.

Further, to engage the tip of the posts, cams 132 are configured with two spaced apart cam plates that form a yoke cam. Positioned between the two cam plates are two hook-shaped fingers that engage the tip of the posts and pull on the post to provide a pulling force on the posts to thereby pull the footboard toward the frame to provide a tighter fit. For example, the tips of the posts may each be T-shaped, with the fingers wrapping around the horizontal portion of the T-shaped tips. Alternately, the tips may be spherical bodies, again with the hook-shaped fingers wrapping around opposed sides of the spherical bodies.

Handle 140 is a rotatable handle with a disk shaped body 142 that is rotatably mounted to footboard 112 so that it is accessible from the outwardly facing side of footboard 112 and accessible to a caregiver. Optionally, handle 140 includes an arcuate handgrip portion 144, which projects outwardly from disk shaped body 142 to facilitate turning of disk shaped body 142. As best understood from FIG. 4, as handle 140 is rotated clockwise (as viewed in FIG. 4), lever arms 136 rotate left cam 132 in the clockwise direction and right cam 132 in a counter clockwise direction. In the illustrated embodiment, left and right cams 132 have mirror image constructions, with each having arcuate fingers that when rotated engage or disengage from the tips of the pins 116 as described above.

Figure 5:
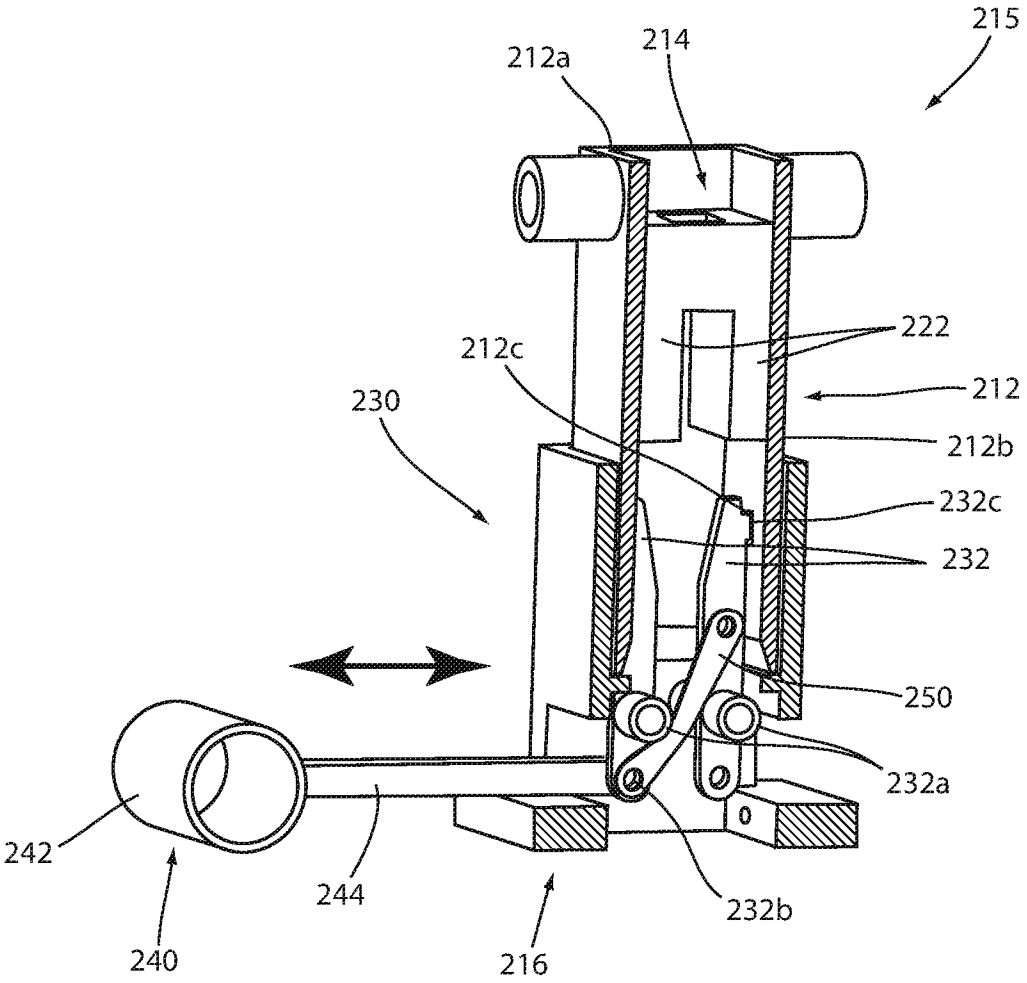
FIG. 5 is an enlarged view of another embodiment of a mounting structure for a footboard.

Referring to FIG. 5, the numeral 230 designates another embodiment of a locking mechanism that is incorporated into a mounting structure 215, which mounts a footboard to a bed frame, via a footboard mounting base. While only one locking mechanism is illustrated, it should be understood the locking mechanism 230 may be used on each post/socket mounting arrangement. Locking mechanism 230 is configured to lock or unlock a footboard post 212 (which is mounted at its upper end 212*a* to the footboard) onto or from a bed frame socket 216 (which is formed in or attached on to the bed frame) by pushing or pulling on a handle 240. As will be more fully described below, handle 240 controls the movement of internal locking members that engage post 212 when handle 240 is pushed and disengage from post 212 when handle 240 is pulled (as shown by the arrow in FIG. 5). Handle 240 comprises a handgrip portion 242, such as a cylindrical member, and a tether 244, such as a rod or bar, which couples to a pair of spaced apart arms or fingers 232, which are mounted in socket 216. Arms 232 are pivotally mounted in socket 216 between an unlocked position and a locked position where the arms engage post 212. As noted above, arms 232 are pivoted by handle 240.

As best seen in FIG. 5, each arm 232 is pivotally mounted in a socket 216 by a post 232*a* above its lower end. One of the arms (left arm in FIG. 5) is also pivotally coupled at its lower end (below post 232*a*) to handle 240 by a pin 232*b*, for example, to the distal end of tether 244. Arms 232 are then coupled together by a link 250, which is coupled on one end to the lower end of the left arm (as viewed in FIG. 5), optionally at the same location as the pin connection to handle 240, formed by pin 232*b*. The other end of link 250 is pivotally connected to a medial portion of the right arm (as viewed in FIG. 5) and extends between posts 232*a* so that posts 232*a* form fulcrum points for link 250 when link is pulled or pushed by left arm 232 (as viewed in FIG. 5). With this arrangement, link 250 translates the pivotal movement of the one arm (the left arm, as viewed in FIG. 5) to pivotal movement in the other arm (the right arm, as viewed in FIG. 5), but in an opposed direction. In this manner, when handle 240 is pulled arms 232 pivot about posts 232*a* so that the upper ends of arms 232 pivot inwardly away from the inner surface of post 212 to disengage from the inner surface of post 212. And, when handle 240 is pushed, the upper ends of arms 232 pivot about posts 232*a* away from each other toward the opposed inwardly facing sides of wall 212*b* of post 212.

Further, each arm 232 includes a tab 232*c* for extending into a corresponding notch or recess 212*c* formed in walls 212*b* of post 212 so that arms 232 mechanically interlock with post 212 when post 212 is fully inserted into the socket 216 and handle 240 is pushed to its locked position.

Referring again to FIG. 5, post 212 includes a downwardly depending U-shaped member 214, with downwardly depending arms 222, which is slidably mounted in post 212 and urged downwardly onto arms 232 by a spring (not shown). Thus, when post 212 is pushed into socket 216, member 214 is urged downwardly by the spring, which applies a downward force on arms 232 to hold arms 232 in place.

Figure 6:
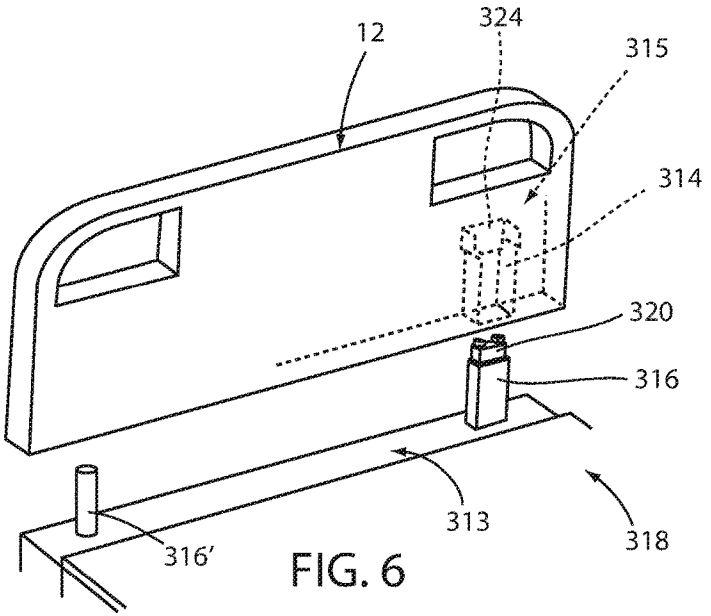
FIG. 6 is an exploded perspective view of another embodiment of a mounting arrangement of a footboard on a person support apparatus.

It should be understood that the location and construction of the mounting structures may vary. For example, referring to FIG. 6, a single set of mounting structures 315 with electrical connections may be provided in the form of a post/socket arrangement that includes a single set of electrical connectors 320, 324. Similar to the previous embodiment, the electrical connectors are mounted in the post and socket, which make connection only after the socket is mounted onto the post.

Figure 7:
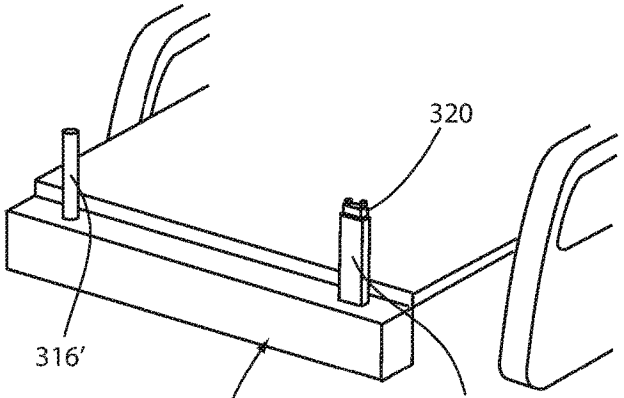
FIG. 7 is a perspective view of the mounting structures provided in the bed frame of the person support apparatus of FIG. 6.
Figure 8:
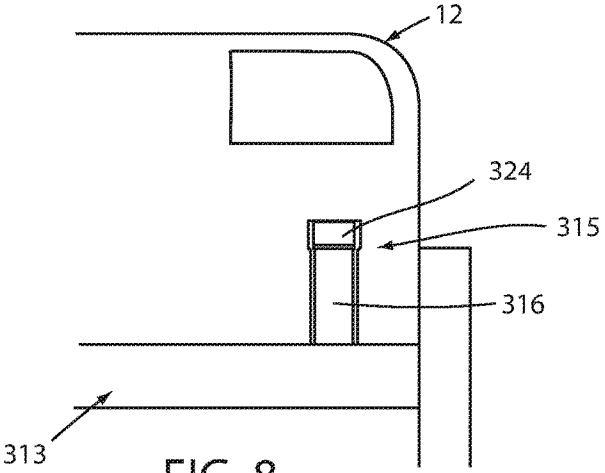
FIG. 8 is an enlarged fragmentary view of the mounting structures of FIGS. 6 and 7.

In the illustrated embodiment, a post 316 is mounted to the bed frame 318, for example, by way of footboard mounting base 313, and comprises a rectangular post with electrical connector 320 provided at its distal end. For example, electrical connector 320 may be fixed to the distal end of post 316. A socket 314 is similarly mounted or formed in the footboard and is rectangular with electrical connector 324 located at its distal end. Optionally, electrical connector 324 is mounted with a floating arrangement in socket 314. In this manner, as shown in FIG. 8, the electrical connection provides one fixed connector with one floating connector. A second post 316' (FIG. 7) may be similar to post 316 or may have a different shape, such as a round post and may or may not have electrical connectors. In the illustrated embodiment, post 316' does not include an electrical connector, nor does its corresponding socket (not shown).

Figure 9:
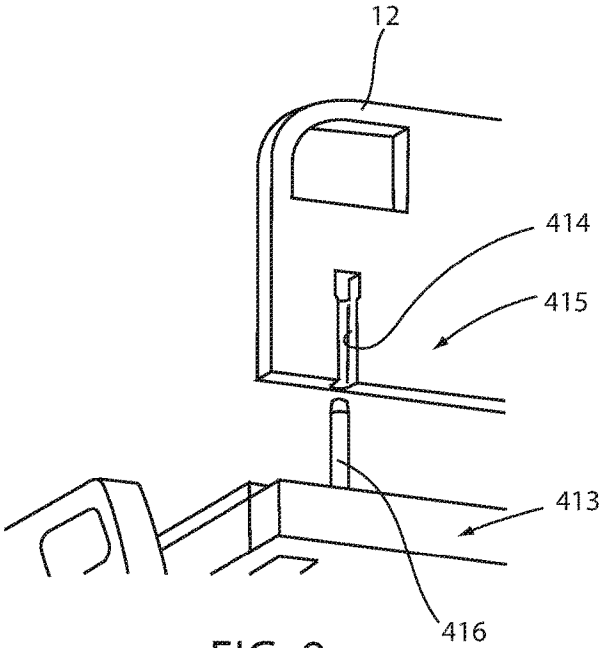
FIG. 9 is an exploded perspective view of another embodiment of a mounting arrangement of a footboard on a person support apparatus.
Figure 10:
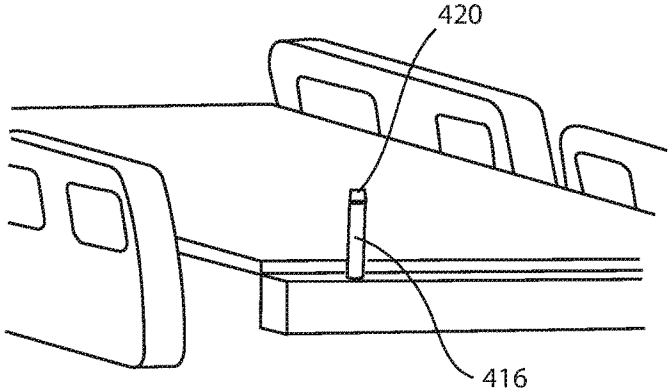
FIG. 10 is a perspective view of the mounting structures provided in the bed frame of the person support apparatus of FIG. 9.
Figure 11:
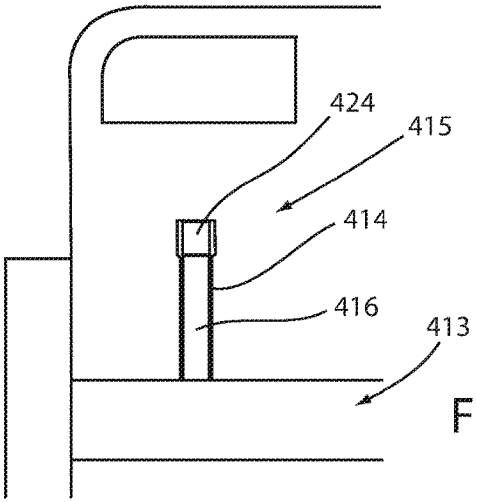
FIG. 11 is a fragmentary view of the mounting structures of FIGS. 9 and 10.

Referring FIGS. 9 to 11, another embodiment of a mounting structure 415 with electrical connectors is shown. The mounting structure 415 is similar to the mounting structure of the previous embodiment except that it includes a round post 416 (which is mounted to the bed frame via a footboard mounting base 413) that is received in a round socket 414 (which is mounted or formed in the footboard). For further details reference is made to the previous embodiment.

Further in this embodiment, the single combined mounting structure with electrical connectors 420, 424 is provided on the left side of the foot end of the bed as compared to the right side of the bed, as shown in previous embodiment. Again, the other mounting structure (right side mounting structure) may or may not include any electrical connectors.

Figure 13:
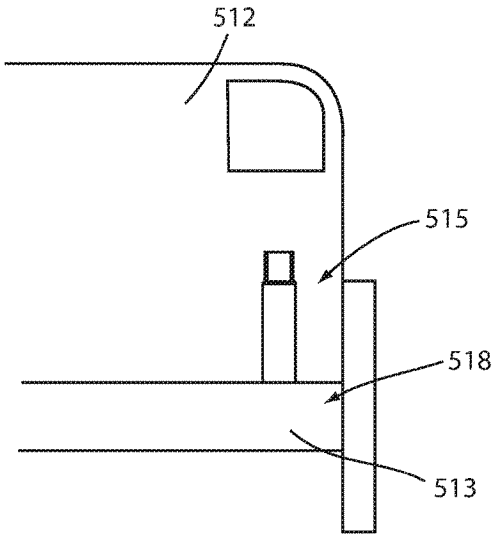
FIG. 13 is fragmentary view of the mounting structures of FIG. 12.
Figure 12:
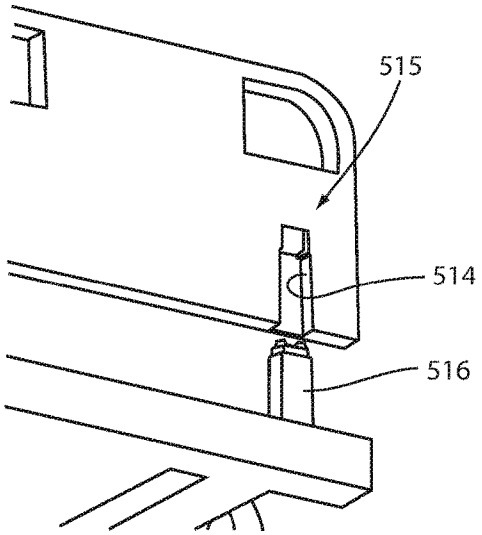
FIG. 12 is an exploded perspective view of another embodiment of a mounting arrangement of a footboard on a person support apparatus.
Figure 14:
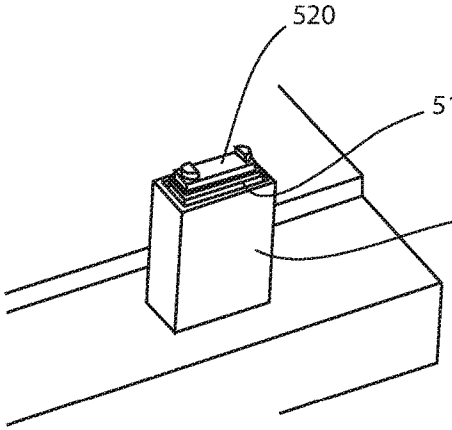
FIG. 14 is an enlarged perspective view of the mounting structure of FIGS. 12 and 13.

Referring to FIGS. 12-14, the numeral 515 designates yet another embodiment of a mounting structure for mounting a footboard 512 to bed frame 518 via a footboard mounting base 513. In the illustrated embodiment, mounting structure 515 includes an electrical connector 520 mounted to a post 516 either within a sleeve or an inner post 516*a* mounted in post 516. For example, the sleeve or inner post 516*a* may be slidably mounted in outer post 516 and biased in its extended position by spring located within the outer post below or within the sleeve or inner post 516*a*. In this manner, the post-within-a-post construction removes some of the mechanical loading from the connector and places it instead on the outer post.

Figure 16:
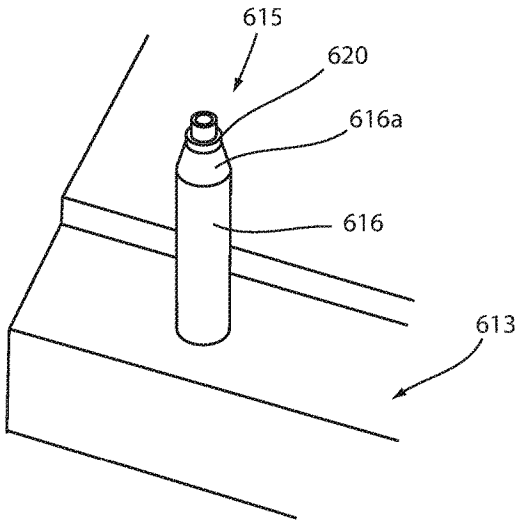
FIG. 16 is an enlarged perspective view of the mounting structure of FIG. 15.
Figure 17:
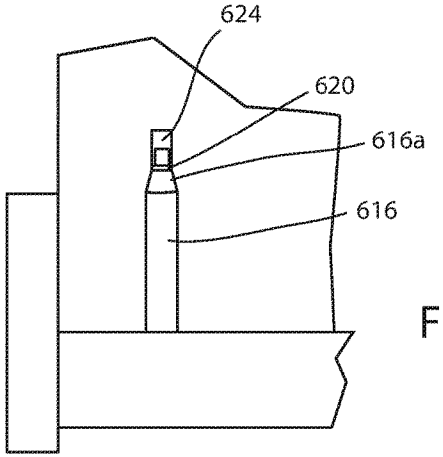
FIG. 17 is a fragmentary elevation view of the footboard and mounting structure of FIGS. 15 and 16.
Figure 15:
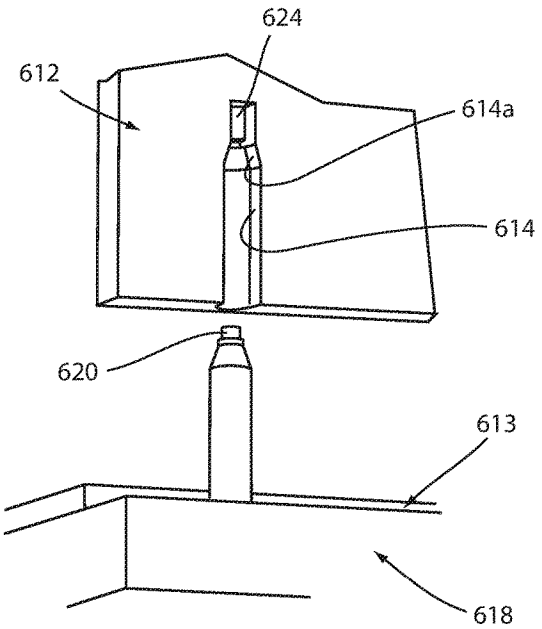
FIG. 15 is an exploded perspective view of another embodiment of mounting arrangement of a footboard on a person support apparatus.

Referring to FIGS. 15 through 17, another embodiment of a mounting structure 615 is illustrated in which an electrical connector 620 is mounted to the distal end of a post 616 (mounted to the bed frame 618 via footboard mounting base 613), and with the distal end of post 616 including a chamfered edge 616*a*. A corresponding electrical connector 624 is located in a socket 614 provided in the footboard 612 (FIG. 15). Socket 614 may also include a corresponding chamfered upper surface 614*a*, which together with chamfered edge 616*a* of post 616 can take the loading off the electrical connectors 620 and 624. Again, either of the electrical connectors may be mounted in or to their respective post/socket using a floating mount.

Figure 19:
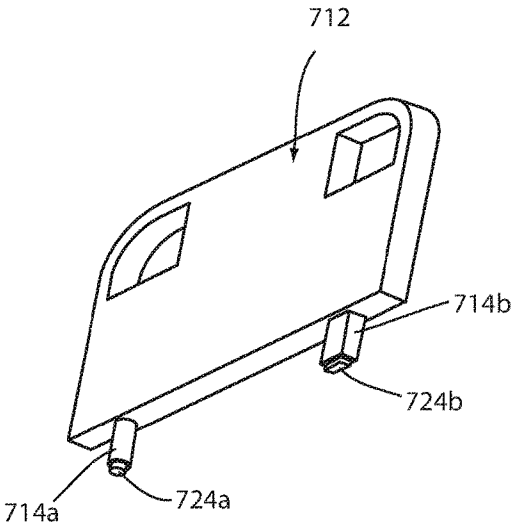
FIG. 19 is a bottom perspective view of the footboard of FIG. 18.
Figure 18:
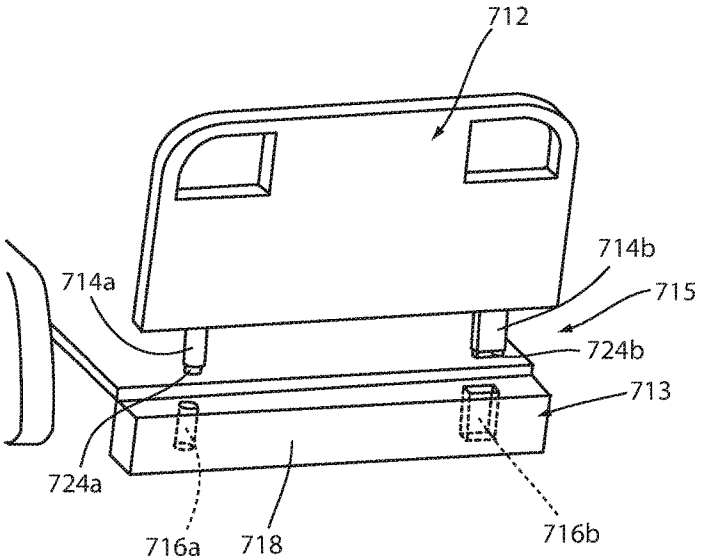
FIG. 18 is an exploded perspective view of another embodiment of a mounting arrangement of a footboard on a person support apparatus.
Figure 20:
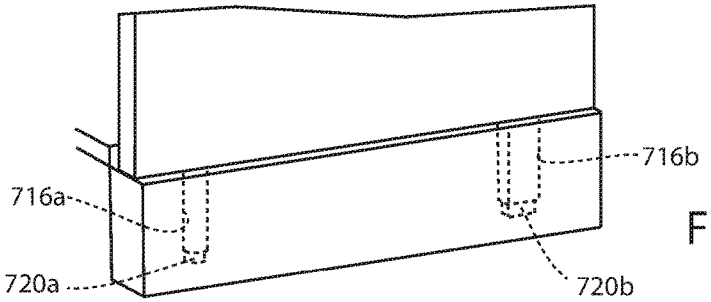
FIG. 20 is a perspective view of the footboard and a person support apparatus of FIG. 18.

Referring to FIGS. 18 through 20, the numeral 713 generally designates another embodiment of a pair of mounting structures for mounting a footboard 712 to a bed frame 718, again, for example, via a footboard mounting base 713. In the illustrated embodiment, footboard 712 includes a pair of downwardly depending posts 714*a* and 714*b*, each including electrical connector 724*a*, 724*b*, which are in electrical communication with one or more electrical devices housed within footboard 712. In the illustrated embodiment, post 714*a* comprises a round post, while post 714*b* is configured as a rectangular post. It should be understood that the posts may have a similar cross-section or other cross-sections.

Posts 714*a* and 714*b* are configured to extend into corresponding sockets 716*a* and 716*b* provided in bed frame 718, which includes corresponding electrical connectors 720*a*, 720*b* with which electrical connectors 724*a*, 724*b* make contact when posts 714*a* and 714*b* are inserted into the respective sockets 716*a* and 716*b*. In the illustrated embodiment, electrical connectors 724*a*, 724*b* are fixed to the distal ends of the respective posts 714*a* and 714*b*. Optionally, electrical connectors 720*a*, 720*b* are located in sockets 716*a* and 716*b* with a floating mount.

Figure 22:
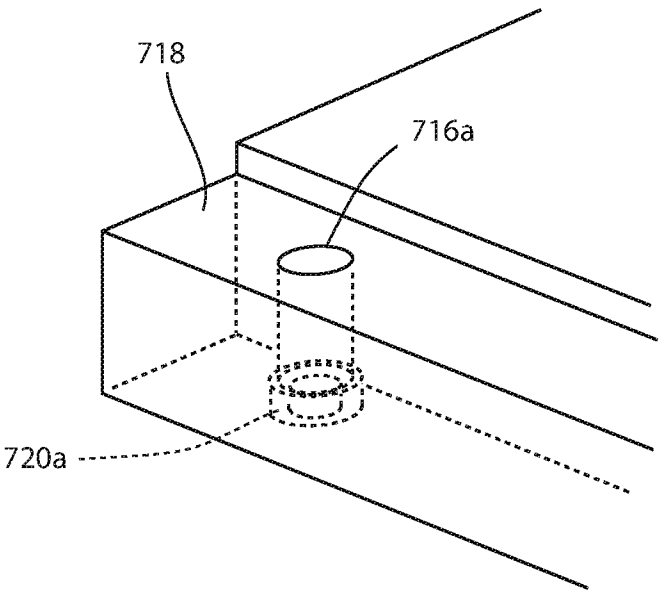
FIG. 22 is an enlarged view of the left socket in the bed frame of FIGS. 18 and 20.
Figure 21:
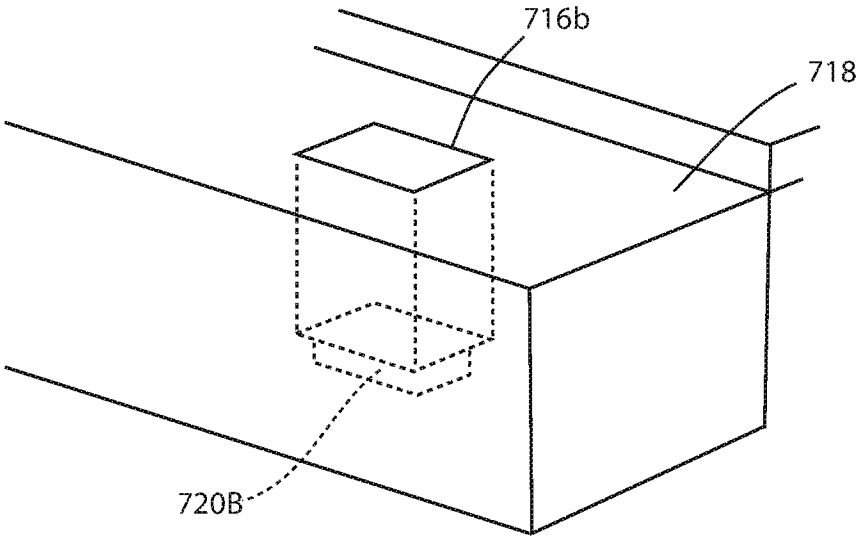
FIG. 21 is an enlarged view of the right socket in the bed frame of FIGS. 18 and 20.

Referring to FIGS. 21 and 22, electrical connectors 720*b* and 720*a*, as noted above, are located within the respective sockets by floating mounts. Alternately, electrical connectors 724*a* and 724*b* may be mounted with floating mounts, while electrical connectors 720*b* and 720*a* may be mounted with fixed connections in sockets 716*a*, 716*b*. By providing connectors that float, the effect of the mechanical push/pull loading on the electrical connections may be reduced, with mechanical load instead taken up by the mounting posts.

Figure 23:
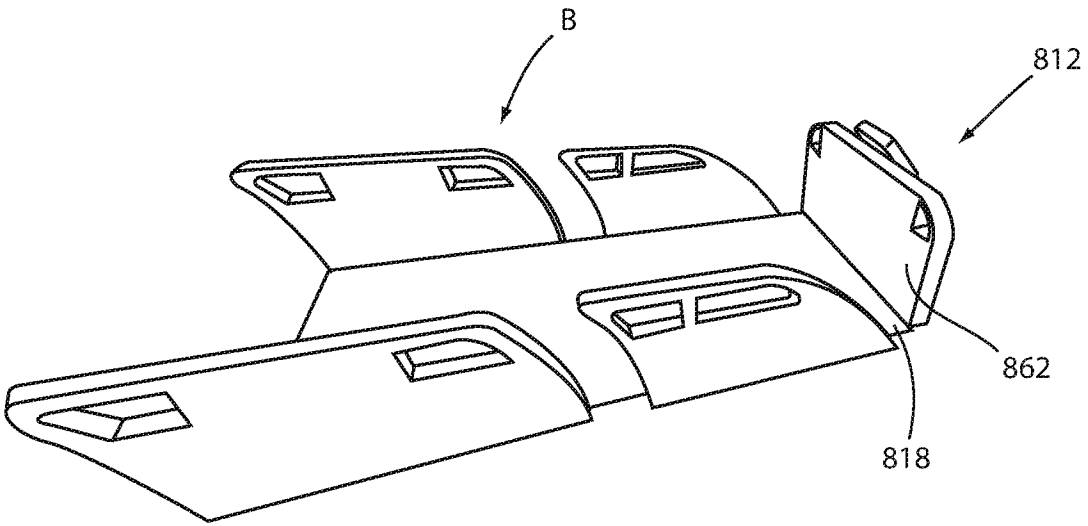
FIG. 23 is a perspective of a person support apparatus illustrating another embodiment of a footboard with a pedestal.
Figure 24:
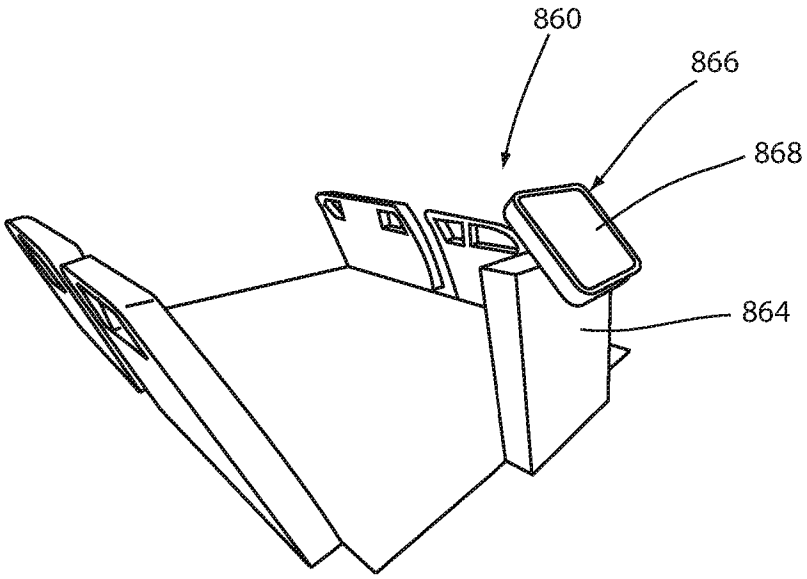
FIG. 24 is an end perspective view of the person support apparatus of FIG. 23 with a portion of the footboard removed.

Referring to FIG. 23, the numeral 812 generally designates another embodiment of a footboard, which is suitable for mounting to a person support apparatus, such as a hospital bed B. As will be more fully described below, footboard 812 is configured to be removable but without requiring the electrical connections for the electrical device or devices at the footboard to be disconnected when the footboard is removed.

Referring to FIGS. 23-27, footboard 812 includes a pedestal 860 that houses one or more electrical devices that are electrically connected to the bed-base control system. As will be more fully described below in reference to FIGS. 37-41, footboard 812 includes a footboard body 862 that is separable from pedestal 860, so that the pedestal 860 may remain in position while the footboard body 862 is moved or removed, so that the electrical device housed in or at pedestal 860 can remain connected to the bed-based control system.

Pedestal 860 includes upwardly depending pedestal housing 864, which is mounted to bed frame 18. For example, pedestal housing 864 may be mounted with a fixed connection to bed frame 18 or may be pivotally mounted to bed frame 18, as described in reference below in reference to FIG. 43.

In the illustrated embodiment, pedestal housing 864 supports an electronics housing 866 that may, for example, include a display 868, such as a touchscreen display, and various other optional electronics, such as those described below. Electronics housing 866 is in electrical communication with the bed base control system through wires or cables located in housing 864, which is mounted to the frame 818. For example, electronics housing 866 may be powered by the bed base control system through wiring or cabling system that extend through pedestal housing 864 and may also be in communication with the bed base control system wirelessly.

Figure 26:
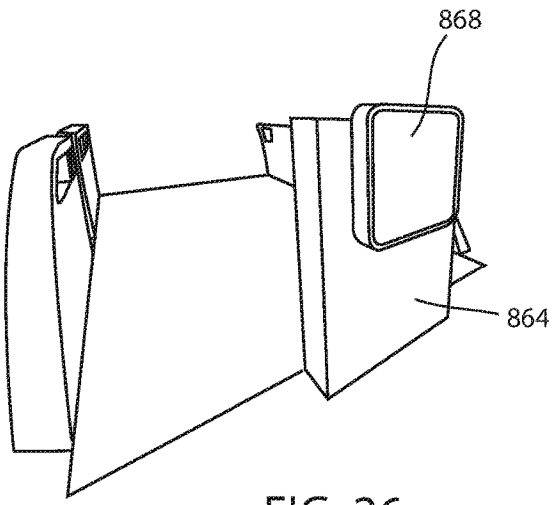
FIG. 26 is an end perspective view of the person support apparatus of FIG. 25.
Figure 25:
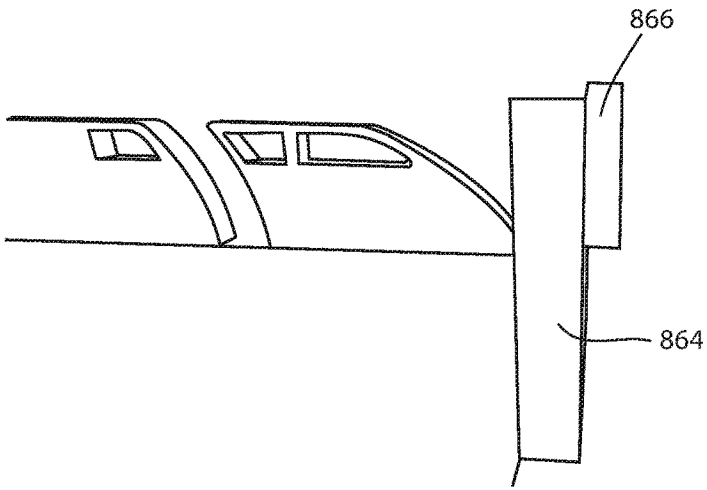
FIG. 25 is a side elevation view of the person support apparatus of FIGS. 23-24 illustrating the display in a folded configuration.
Figure 27:
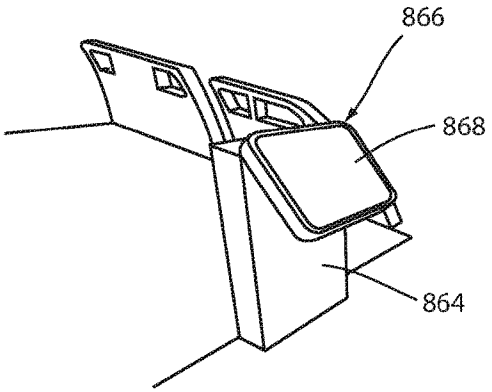
FIG. 27 is a similar view to FIG. 24.
Figure 29:
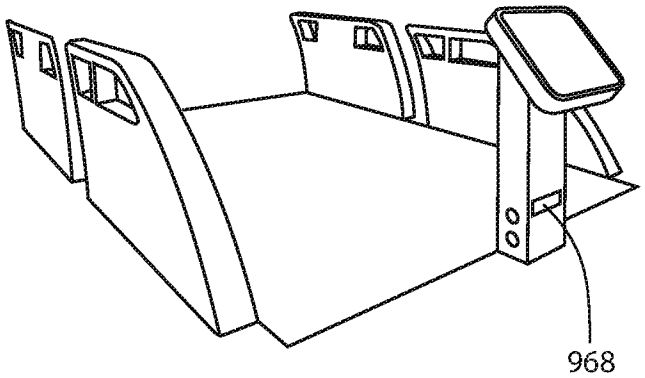
FIG. 29 is a perspective view of another embodiment of a footboard pedestal with a display.

Optionally, the electronics housing 866 may be pivotally mounted to pedestal housing 864 so that display 868 can be positioned to suit the caregiver's needs. For example, display 868 may be repositioned between a vertical orientation, such as shown in FIGS. 25 and 26, or a tilted position, for example, in a range of 5° to 90° from vertical plane, as noted above to suit the needs of the caregiver.

As would be understood, the width of housing 864 may be varied. One goal of the pedestal is to allow the footboard body 862 to be removed to allow access to the mattress or to the person. Accordingly, the width of housing 864 may be chosen such that it does not interfere with the ability of a caregiver to access the mattress or the person. In the illustrated embodiment, the width of housing 864 is greater than the width of electronics housing 866 but is still sufficiently narrow to allow access by a caregiver to the person or mattress supported on the bed.

Referring to FIGS. 28 through 35, the numeral 960 refers to another embodiment of the pedestal. In the illustrated embodiment, pedestal 960 includes an electronics housing 962 and a pedestal housing 964, which supports electronics housing 962. In this embodiment, the pedestal housing 964 has a width narrower than the electronics housing 962. Additionally, pedestal housing 964 supports additional electrical devices, such as lights, including iBed Awareness lights sold by Stryker Corporation of Kalamazoo Mich., user input devices, such as buttons, including capacitive mechanical buttons, ports, such as DVT pump ports, USB ports, outlets or auxiliary ports, or the like. For further details of an iBed Awareness light reference is made herein to U.S. Pat. No. 8,689,376 and U.S. patent application Ser. No. 13/035,544, filed on Feb. 25, 2011, which are commonly owned by Stryker Corporation of Kalamazoo, Mich. and incorporated by reference herein in their entireties.

Figure 28:
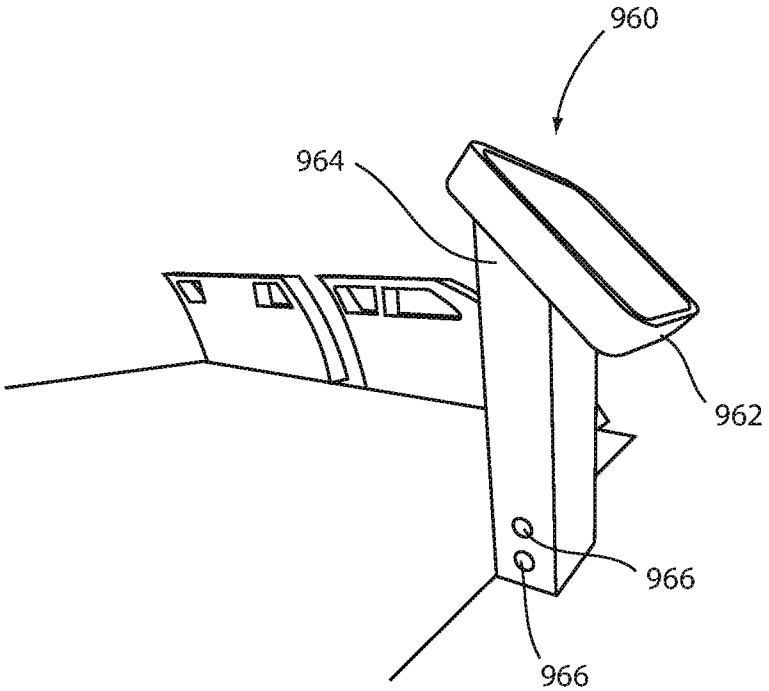
FIG. 28 is an enlarged view of another embodiment of a footboard pedestal with a display.

For example, referring to FIG. 28, pedestal housing 964 may include ports 966, including DVT pump ports, USB ports, electrical outlets, or auxiliary ports, at a side of the housing, which are accessible when the footboard body is removed. Optionally, ports 966 may be provided on the front face of the pedestal housing so that the ports are accessible even when the footboard body is returned to its foot end position about the pedestal.

As noted above, pedestal 960 includes lights 965, 970. For example, referring to FIGS. 29 and 30, a light or lights 970 may be provided in the electronics housing above display screen 968 or may be located in the outwardly facing side of pedestal housing 964 so the light is viewable by a caregiver regardless of whether the footboard body is removed or in position at the foot end of the bed.

Figure 31:
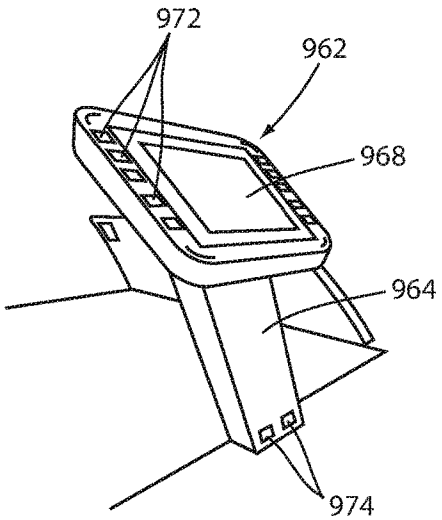
FIG. 31 is an enlarged perspective view of another embodiment of the footboard pedestal.
Figure 30:
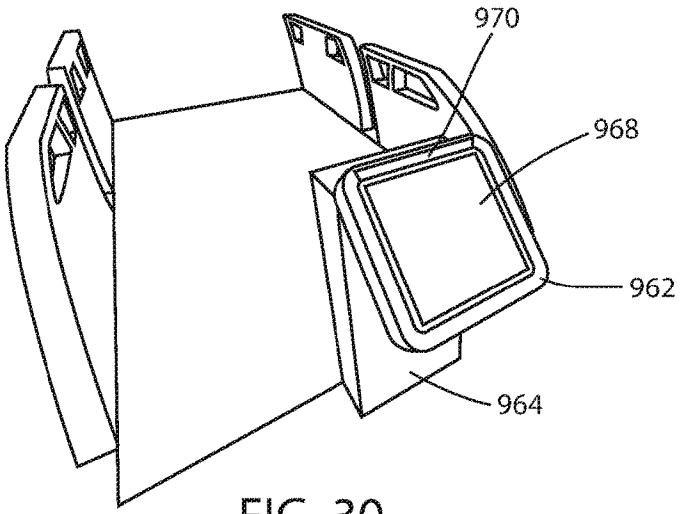
FIG. 30 is another perspective view of the footboard pedestal.
Figure 32:
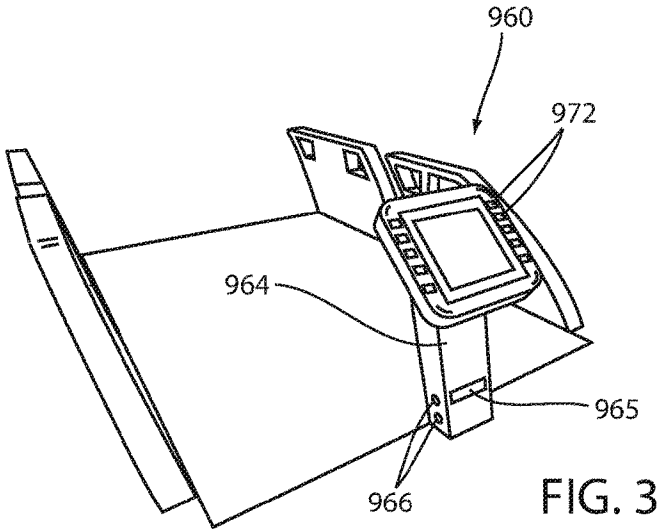
FIG. 32 is a perspective view of another embodiment of the footboard pedestal with display and various controls and inputs.

Referring to FIGS. 31 and 32, user input devices 972, such as buttons, including capacitive or mechanical buttons, may be provided in electronics housing 962. For example, user input devices 972 may be located around display 968 to provide additional functionality beyond the functionality provided by display 968. As noted above, display 968 may comprise a touch screen, which may provide input to the bed to control the bed and provide other functions, such as described in U.S. Pat. Nos. 7,962,981; 9,038,217; and 8,413,271, which are commonly owned by Stryker Corporation of Kalamazoo, Mich. and are incorporated by reference herein in their entireties.

Figure 33:
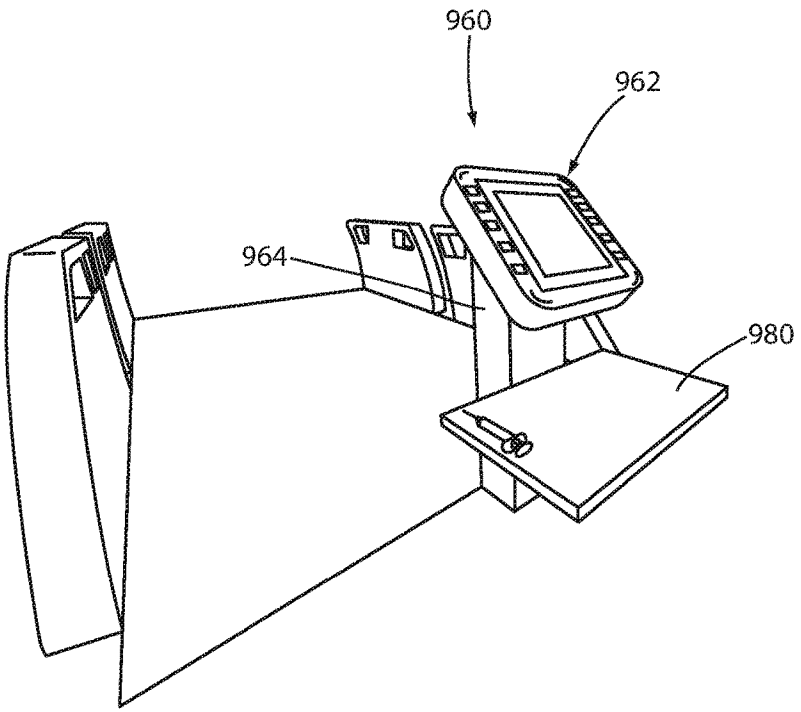
FIG. 33 is a perspective view of yet another embodiment of the footboard pedestal with a tray.
Figure 34:
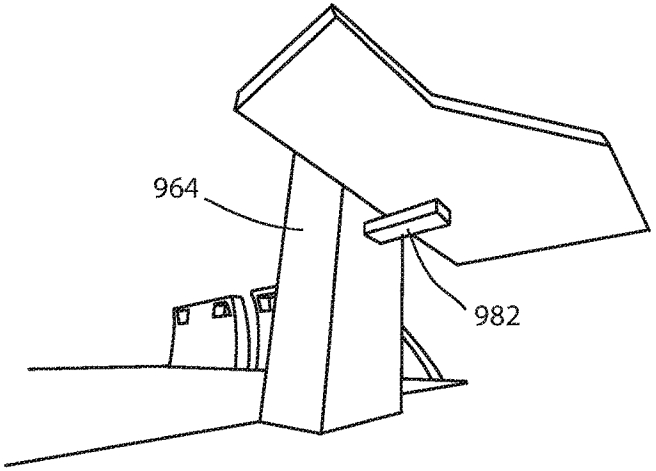
FIG. 34 is an enlarged bottom perspective view of the footboard pedestal of FIG. 33.

As best seen in FIG. 31, auxiliary port outlets 974 are provided in pedestal 960, for example, in pedestal housing 964. Referring to FIGS. 33-34, in one embodiment, pedestal 960 incorporates a tray 980. For example, tray 980 may be mounted to pedestal housing 964 by a bracket 982 (FIG. 34), which is either formed on or attached to pedestal housing 964. Tray 980 provides a working surface for holding items, such as tools used by nurse or caregiver. Tray 980 may be either removable or integrally formed with the pedestal housing 964.

Figure 36:
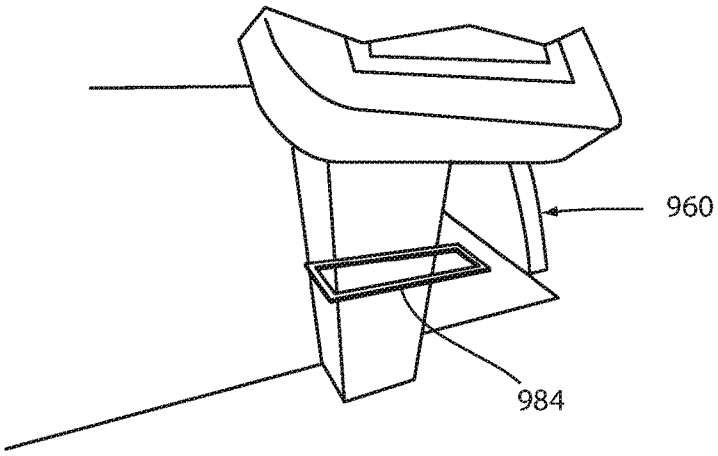
FIG. 36 is another perspective view of the footboard pedestal of FIG. 35 with the device removed.
Figure 35:
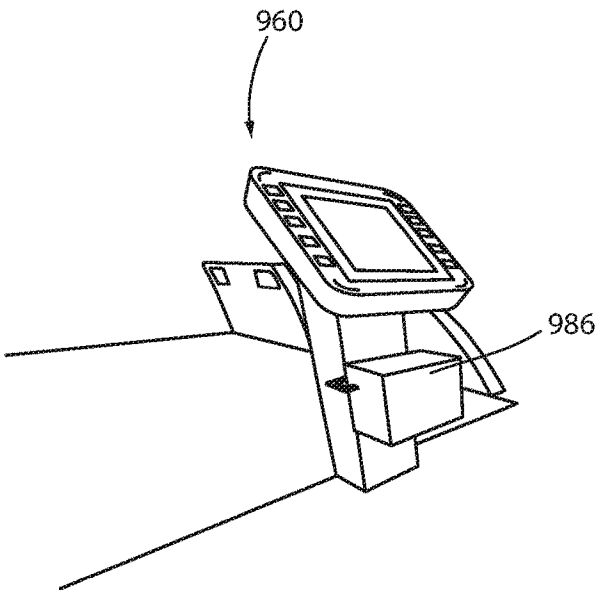
FIG. 35 is an enlarged partial perspective view of another embodiment of a footboard pedestal with a device holder, such as a pump holder.

Referring to FIGS. 35 and 36, pedestal 960 may include a bracket 984 for holding an item, such as a pump box 986, such as shown in FIG. 35. In the illustrated embodiment, bracket 984 comprises a wire frame bracket, which is configured to hold, as noted above, a pump box 986. It should be understood that bracket 984 may be configured to hold other devices.

As described above, footboard 812 includes pedestal 860 and footboard body 862, which mounts about pedestal 860. Footboard body 862 can be removed from bed B, leaving pedestal 860 attached to bed B so that the electrical connections between the electronics or electrical devices in pedestal 860 and the bed-based control system may remain intact.

Figure 38:
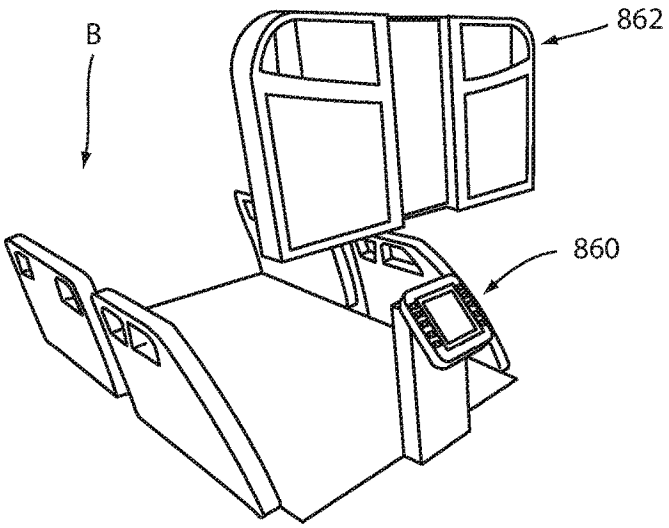
FIG. 38 is an exploded perspective view of a footboard of FIG. 37.
Figure 37:
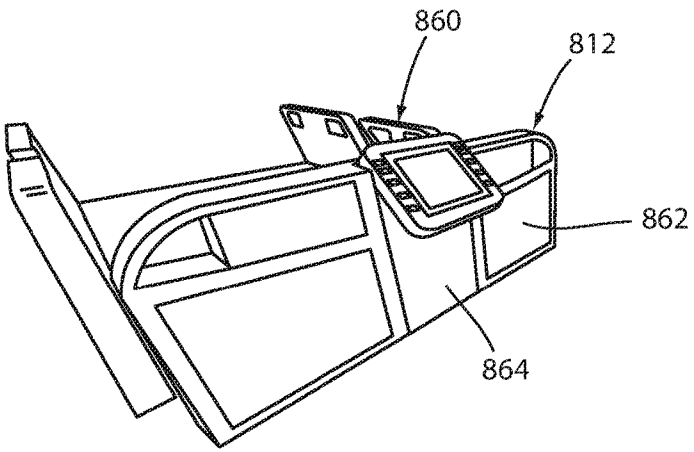
FIG. 37 is a foot end perspective view of the footboard of FIG. 23.
Figure 39:
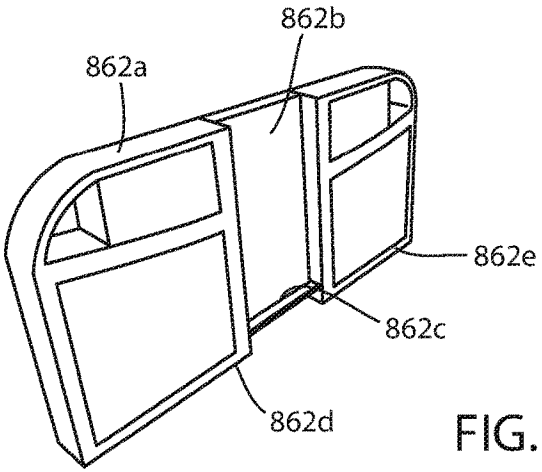
FIG. 39 is a perspective view of a portion of the footboard of FIG. 37.

Although not shown, any number of different types of releasable mounting structures may be used to mount footboard body 862 with the bed frame of bed B, including the mounting structures described above. As best seen in FIGS. 37-39, footboard body 862 includes a perimeter frame that forms the outline of the footboard, including an upper side, opposed left and right sides, and a lower side of the footboard. Centrally located in the body and frame is an opening 862*b* that is sized to receive pedestal 860 and further straddles pedestal 860 so that when footboard body 862 is mounted to bed B, pedestal 860 appears to be part of the footboard. The lower side 862*c* of the frame, at least at the lower end of the opening, is offset so as to straddle the pedestal housing, which is mounted to the bed frame within the foot print of the footboard.

The thickness of the footboard body may be commensurate with the pedestal housing 864 in which case either the pedestal housing or the electronics housing projects from the footboard, e.g. from between panels 862*d* and 862*e*. Alternately, footboard body 862 width may be commensurate with the width of pedestal housing 864 and the width of electronics housing 866 (when electronics housing 866 is in its vertical orientation) combined. In this manner, pedestal housing 864 and electronics housing 866 can lay between the two vertical planes defined by the two outward faces of footboard panels 862*d* and 862*e* when electronics housing 866 is rotated to its vertical orientation, such as shown in FIG. 25. Optionally, the thickness of footboard body 862 may be greater than the combined width of the pedestal housing 864 and the electronics housing 866 (when it is rotated to its vertical orientation). With this configuration, one or both the pedestal housing 864 and the electronics housing 866 may be recessed within footboard body 862.

Figure 40:
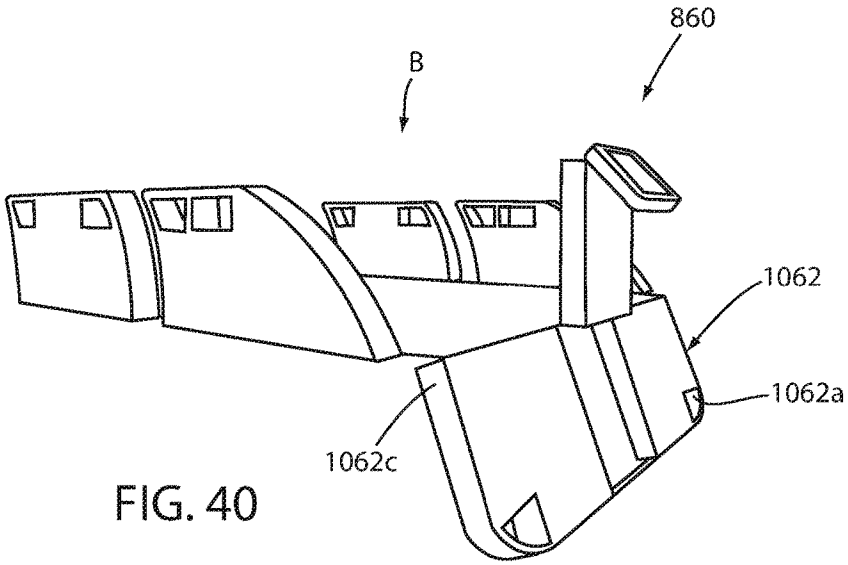
FIG. 40 is a perspective view of another embodiment of a footboard with a pedestal.
Figure 41:
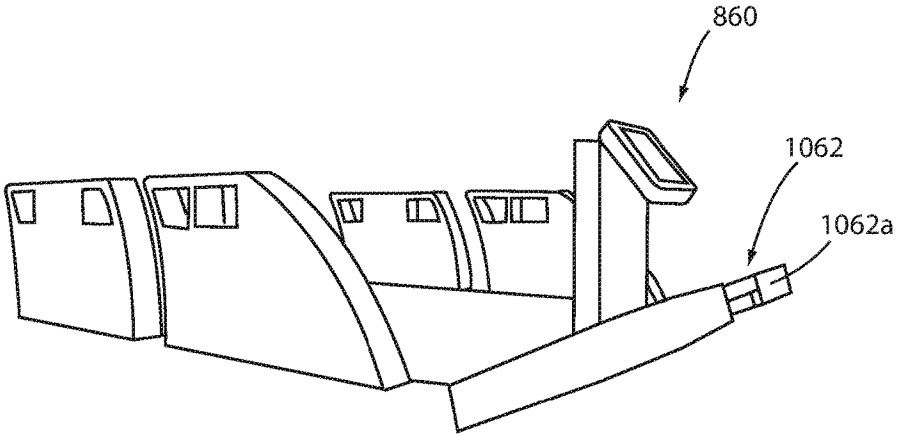
FIG. 41 is a similar view to FIG. 40.

Referring to FIGS. 40 and 41, the numeral 1062 designates another embodiment of a footboard body, which is configured to pivotally mount about the foot end of bed B away from pedestal 860. In the illustrated embodiment, footboard body 1062 includes a frame 1062*a* that forms an upper side, left and right sides, and bifurcated lower side 1062*c*, which allows footboard body 1062 to pivot past pedestal 860 without interference from pedestal 860.

Figure 42:
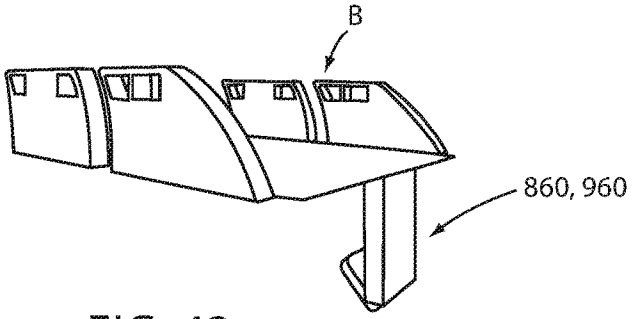
FIG. 42 is a perspective view of another embodiment of a footboard pedestal.

Referring to FIG. 42, either of the above pedestals 860, 960 may be mounted so that it pivots about the foot end of the bed, so that the foot end of the bed is totally unobstructed. Because the pedestal is pivoted rather than being fully disconnected, the electrical connections, as noted above, may still remain intact.

Figure 43:
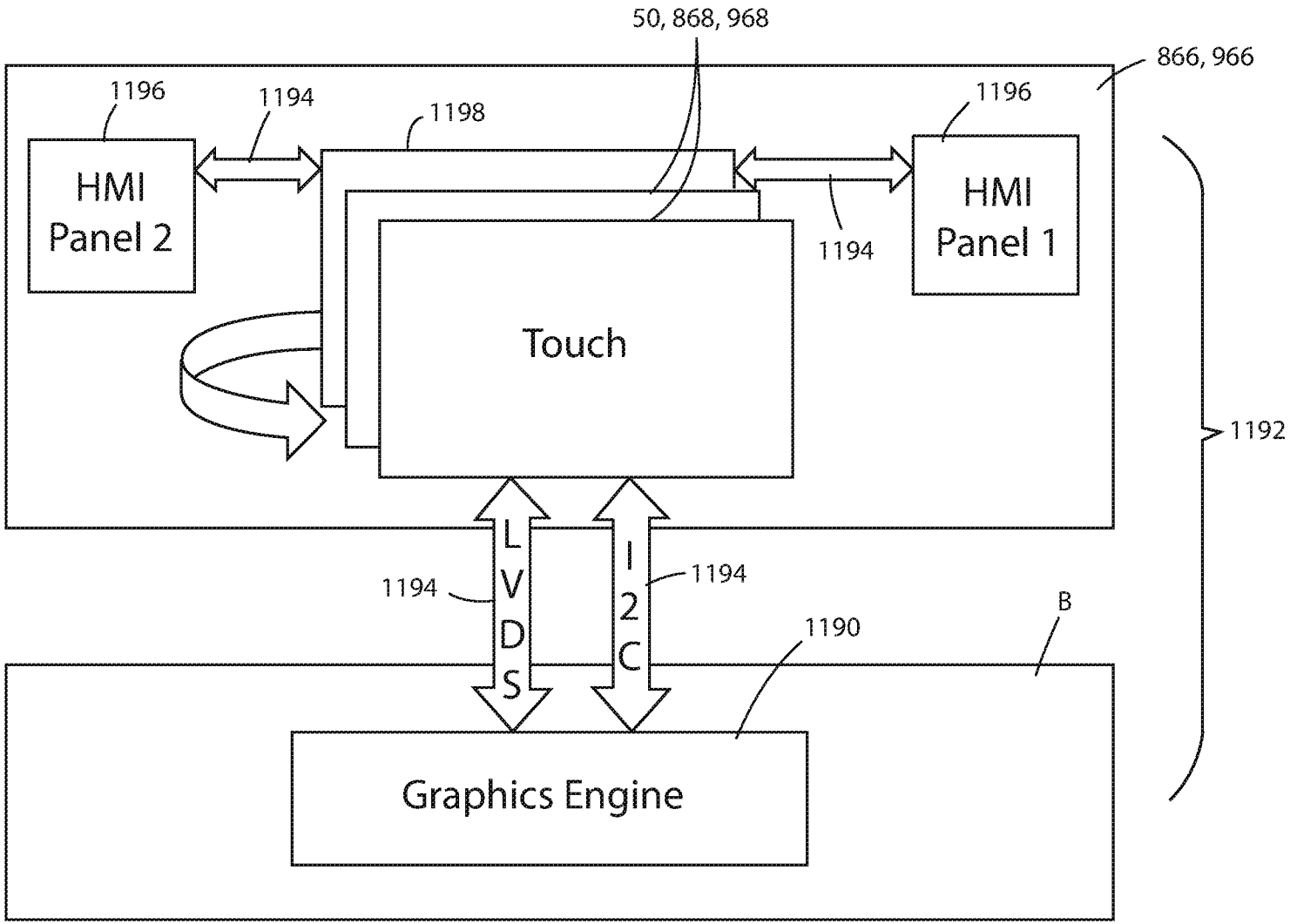
FIG. 43 is a schematic drawing of one embodiment of a control system that may be suitable for any of the displays and/or devices in the above footboards.

Referring to FIG. 43, in any of the above displays, the display and touchscreen may be physically separated from the processor creating the graphics on the display and touchscreen. The graphics on the display and touchscreen are driven by a graphics engine module 1190. In the illustrated embodiment, module 1190 is physically positioned on person support apparatus, such as bed B, and not on or in the footboard. This allows the display (and touch screen) be replaced with a different display in the future without changing the underlying hardware. Newer technologies may then be applied to the footboard without changing the graphics engine module. Hereinafter reference will be made to the display, but it should be understood that this may include the touchscreen as well.

Referring again to FIG. 43, communication system 1192 may include one or more user interface devices, such as human machine interface (HMI) modules 1196, which are in communication with the display and/or touchscreen through an interface 1198 via serial connectors 1194. Suitable connections include I-squared C protocol ($I^2C$). The user interface devices may simply be buttons or other user input devices that allow a person, such as a caregiver to operate features on the footboard or the person support apparatus.

As noted above, graphics engine module 1190 also communicates with the interface 1198 via serial connectors 1194. In some embodiment, serial connectors 1194 are implemented as low voltage differential signaling (LVDS) connectors, for example using shielded cables, although it will be understood that other types of serial connectors can be used. Other connectors may be implemented using RS-232 protocol, an RS-422 protocol, an RS-485 protocol, an I-squared C protocol ($I^2C$), and an IEEE 1394 serial bus protocol (e.g. Firewire). Further, as will be more fully described below, graphics engine module 1190 and the footboard interface 1198, may each include a serializer chip, namely an serDES chip, which converts parallel data into serial data (and vice versa) so that the data from the graphics engine module can be sent over the serial connectors noted above.

For example, as described in co-pending U.S. patent application Ser. No. 14/622,221, filed Feb. 13, 2015, entitled COMMUNICATION METHODS FOR PERSON HANDLING DEVICES, which is commonly owned by Stryker Corporation of Kalamazoo Mich. and which is incorporated by reference herein in its entirety, communication system 1192, which includes both the controls in footboard and the graphics engine module 1190 may include a serDES connection that runs from the graphics engine module 1190 to the footboard (provided by two serDES chips—one on the graphics engine module side and the other on the footboard interface side, as noted below). The serDES connection allows the graphic images that are output from the graphics engine module to be converted to a serial format that is then sent over the serDES connection to the footboard for display on display 868, 968. In other words, the graphics engine module, among other responsibilities, controls the images that are displayed on display 868, 968 of the person support apparatus, such as bed B. By utilizing this serDES connection, a simplified electrical connector (such as the serial connectors noted above) can be used on both the patient support apparatus and on the footboard that electrically bridges the two when the footboard is mounted on the person support apparatus. That is, it is not necessary to include a large number of electrical pins that must align with a corresponding receptacle in order to bridge the electrical connection between the footboard and the person support apparatus, such as is required when sending data in a parallel fashion or otherwise using multiple connections.

In addition to simplifying the electrical connector between the footboard and person support apparatus, the use of serDES connection also enables the footboard to include one or more displays without also including a microcontroller within the footboard. Instead, the footboard may include a conventional, off-the-shelf serDES chip that deserializes the incoming data from graphics engine module 1190 and distributes the data among the electrical components of the footboard, as well as serializes the outgoing data from the footboard that is sent to graphics engine module 1190. Similarly, graphics engine module 1190 includes a conventional, off-the-shelf serDES chip that deserializes the incoming data from the footboard and serializes the outgoing data that is sent to the footboard. By utilizing these serDES chips, which are less expensive than microcontrollers, the cost of replacing missing or damaged footboards becomes less expensive. Though it should be understood that the footboard may include its own microcontroller or processor.

Accordingly, based on what footboard is plugged into the patient support apparatus, a different menu/GUI may be presented to the user, for example a menu/GUI suitable for surgical ward, ICU, cardiology. Further, the display may be configured to offer high-end features or low end features. Further, two displays may be driven from a single graphics engine module (1190). For example, one display may provide bed centric information, while another display could provide electronic medical records (EMR) information.

Further, the resolution of the display may be changed, including by auto sizing or providing a unique ID that describes the resolution of the display when plugged into the system.

In addition, communication system 1192 (FIG. 43) may be connected to a sensor (e.g. 1228), such as an ambient light sensor that detects light in the room to detect room brightness and, therefore, may adjust the display and/or touch screen based on the room brightness.

Further, the use of the serDES chips provides the ability to run multiple independent software environments within a single system on chip (SoC).

In one embodiment, the graphics engine module may employ a dual core or multi core platform. For example, graphics engine module 1190 may include a graphics core 1190*a*, such as a Cortex-A9, and a machine core 1190*b* (Cortex-M4). This provides the capability to deploy a user interface-rich operating system on one core (such as Cortex-A9) and benefit from the real-time determinism provided by another core (such as Cortex-M4). This may be important for a wide range of medical devices that require a more evolved user experience but must have a reliable, secure and deterministic way of communicating with other devices in a network.

By using two cores with different capabilities, a better optimization may be achieved—including a power optimization. For example, a graphics core, such as Cortex-A9, which can process 2D or 3D graphics, as well as high definition video, generally requires more power than, for example, a machine core, such as Cotex-M4, which processes low level functions, such as monitoring sensors, user interfaces, such as buttons, and wireless communication. For example, the graphics core may be put to sleep and only woken up when the machine core detects that the graphics core is needed.

In one embodiment, the controller is configured to operate a safe sharing or exclusive access of SoC resources (peripherals, shared memory) by the Cortex-A9 core and Cortex-M4 core to ensure that the operating environments can coexist independently in a secure manner, i.e. the Cortex-A9 domain will not try to take control of a peripheral that is, and must remain, dedicated to the Cortex-M4 domain. The controller has a full programming model and the entire register map is available to either, or both, cores. This allows the processor to partition the system uniquely to the requirements.

In another embodiment, the processor may be configured to use an authenticated, secure boot (high-assurance boot) to verify that the software boot image is authorized to run on the device. And, with a Cortex-M4 core involved, very fast secure boot times can be realized. High-assurance boot is a security feature that assists in preventing tampered boot images from being run on the device. In addition, cryptographic cipher engines and secure on-chip data storage round out the advanced security offerings of the processor.

In at least one embodiment, flexible boot options, including support for DDR QSPI and raw NAND, and a memory controller that supports both DDR3 and low power DDR2 memory.

In one embodiment, the two cores share a common processor and, further, may share the same memory. For example, a suitable processor is available under the product name i.MX 6SoloX processor available from Freescale Semiconductor, Inc.

Figure 44:
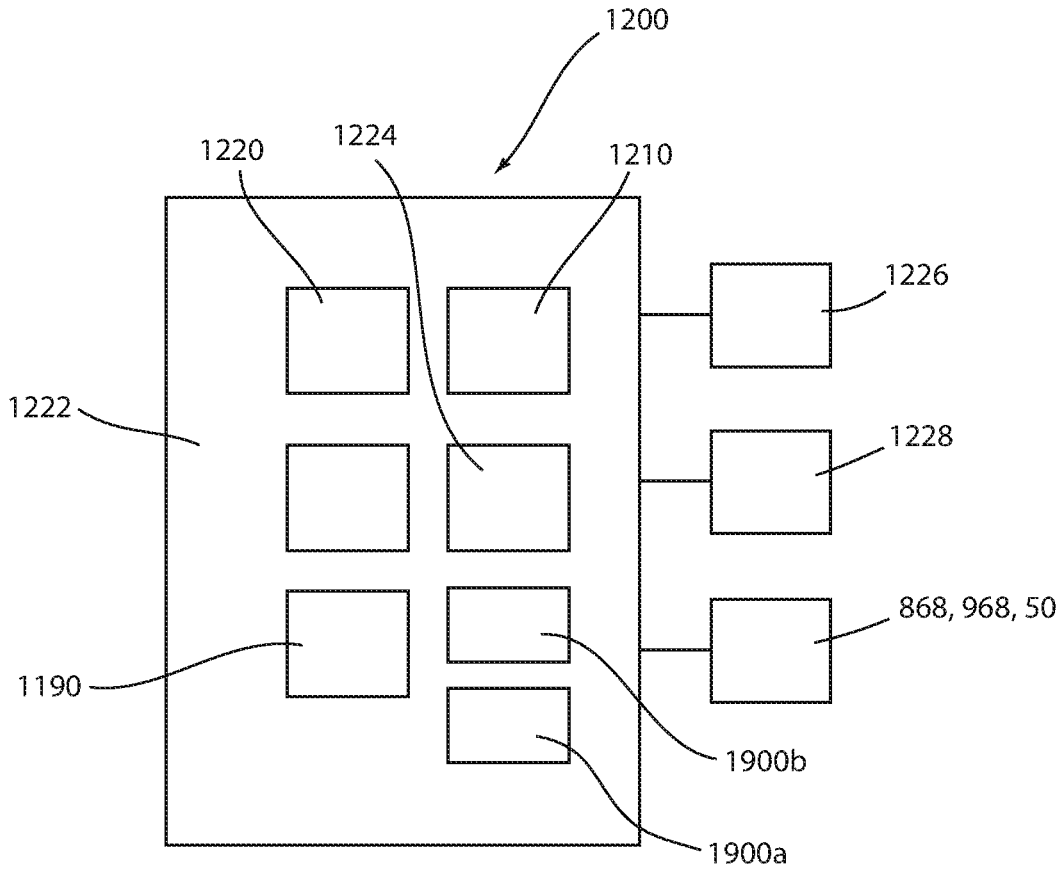
FIG. 44 is a schematic drawing of a bed-based control system.

Referring to FIGS. 43 and 44, system 1192 includes a bed based processor 1200, which includes graphics engine module 1190, cores 1190*a*, 1190*b*, and memory 1210. Additionally, as noted above, processor 1200 may include a power management device 1220, which may manage the power usage, for example, of the cores, and may also include numerous ports and interfaces for various devices, such as a video interface 1222 and a display interface 1224, such as ports for video, such as an MIPI camera port for cameras (such as CSI, NTSC/PAL), ports for audio devices 1226, ports for sensors 1128, and ports for displays (such as parallel RGB, LVDS), including displays and touchscreens 50, 868, 968. Additionally, the processor may include a dual-port for audio and video, such as a dial-port gigabit Ethernet audio video bridging (AVB), as noted below. Further, wireless connectivity support can be added via single-lane PCIe, SDIO, or USB. Alternately, the system may include multiple memories. For example, the processor may host from each memory. For example, one memory may store the graphics for one display, and the other could store the graphics for another display.

In some embodiments, as noted above, independent power domains within the SoC allow to provide smart system power—managing system-level tasks in the most power efficient way. As noted, above, the Cortex-M4 core can be used for low-level system monitoring tasks, such as maintaining a wired or wireless connection, monitoring user interfaces, such as buttons, or gathering inputs from sensors, all while the Cortex-A9 core and other higher-performing peripherals like the 2D and 3D GPU are power-gated. This provides maximum power efficiency during less process intensive, but highly critical, tasks as well as the ability to quickly and significantly scale up the performance and display capabilities of the system.

In at least one embodiment, a dual-port gigabit Ethernet audio video bridging (AVB) may be used for quality-of-service requirements with enhanced packet prioritization.

At least in one embodiment, the graphics engine module may include a 2D and 3D graphics processing unit (GPU) for enhanced human machine interface (HMI) development.

In at least one embodiment, graphics engine module 1190 transmits to the footboard over serDES connection images that are to be displayed on the display that were formatted in a scalable vector graphics (SVG) format. This enables a first footboard to be replaced with a second footboard having another display on it that is of a size different from the size of the display of the first footboard, without requiring any reprogramming on the part of graphics engine module 1190. In other words, graphics engine module 1190 contains memory that stores the images to be displayed on the display in an SVG format. Prior to transmitting these images to the display, graphics engine module 1190 scales these SVG formatted images to a size that matches the size of the display that is included on the footboard. Because the images are stored and/or created in an SVG format, graphics engine module 1190 can easily re-size the images prior to transmission to the footboard without loss of fidelity of the graphic images, and without having to be reprogrammed to generate images that are specifically sized and/or formatted to the particular display that is included with the footboard.

In order to resize the SVG images to the appropriate size, the footboard transmits to graphics engine module 1190 a message that identifies the size of the display to graphics engine module 1190 so that graphics engine module 1190 knows what size to scale the SVG image to. After this message is received, graphics engine module 1190 re-sizes the image data appropriately prior to transmitting it to the footboard over the serDES connection.

The use of SVG graphics for displaying images on the display enables different footboards having differently sized displays to be swapped with each other for use on the person support apparatus without requiring any changes or reprogramming of graphics engine module 1190, or any other components of the person support apparatus. Further, because graphics engine module 1190 is physically located on the patient support apparatus, rather than incorporated into the footboard, upgrading of the footboards having a smaller sized display to a footboard having a larger sized display can be accomplished in a more cost-effective manner.

In still other embodiments, the system may transmit audio packets over the connections, e.g. Ethernet, using the $I^2S$ (aka Inter-IC Sound, or Integrated Interchip Sound, or IIS) standard developed by Philips Electronics of the Netherlands. In some embodiments, the $I^2S$ protocol is used for communicating audio over one or more of the lower speed network connections, which may be provided so that the footboard may be used as a multimedia engine.

In yet another embodiment, as noted above, the system may include a camera interface, such as an MIPI CSI-2, which could run both ways for example to capture images of a person in the patient support apparatus or of a caregiver or visitor who is near adjacent the footboard.

In yet other embodiments, the displays and/or touch screens described herein may include a finish to optimize the viewing angles. For example, the displays and/or touch screens may include anti-glare finish or a non-scratch finish, or they may be formed from a robust hardened glass. Optionally, the displays and/or touch screens further may be sealed for water intrusion, such as described in U.S. Pat. No. 7,861,334, which is commonly owned by Stryker Corporation of Kalamazoo Mich. and which is incorporated by reference herein in its entirety.

Additionally, many of these features, such as ports for video, such as an MIPI camera port for cameras (such as CSI, NTSC/PAL), ports for audio devices, ports for sensors, and ports for displays (such as parallel RGB, LVDS), including displays and touchscreens, may be provided at the footboard interface 1198.

Figure 45:
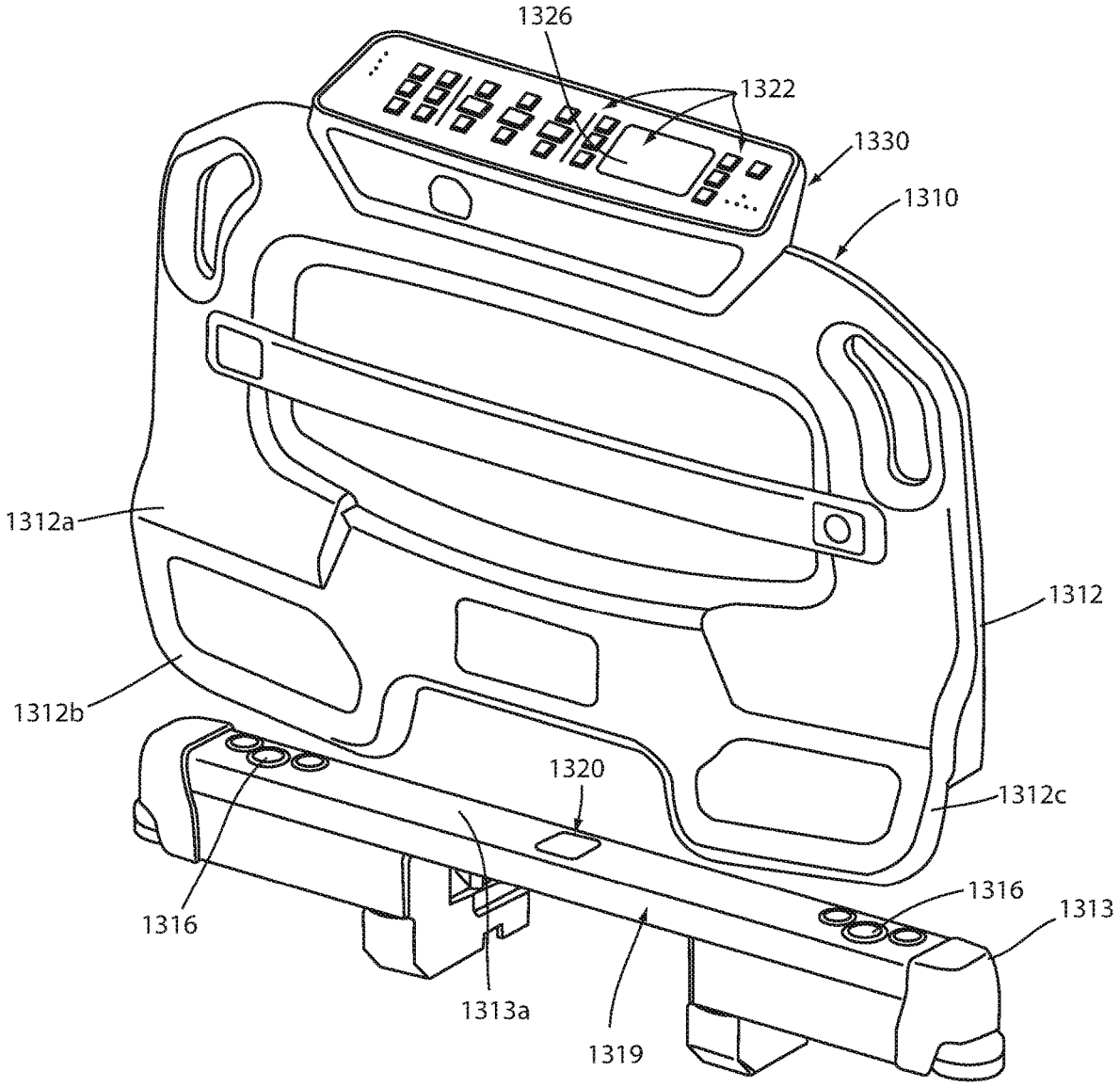
FIG. 45 is an exploded perspective view of another embodiment of a footboard assembly.
Figure 46:
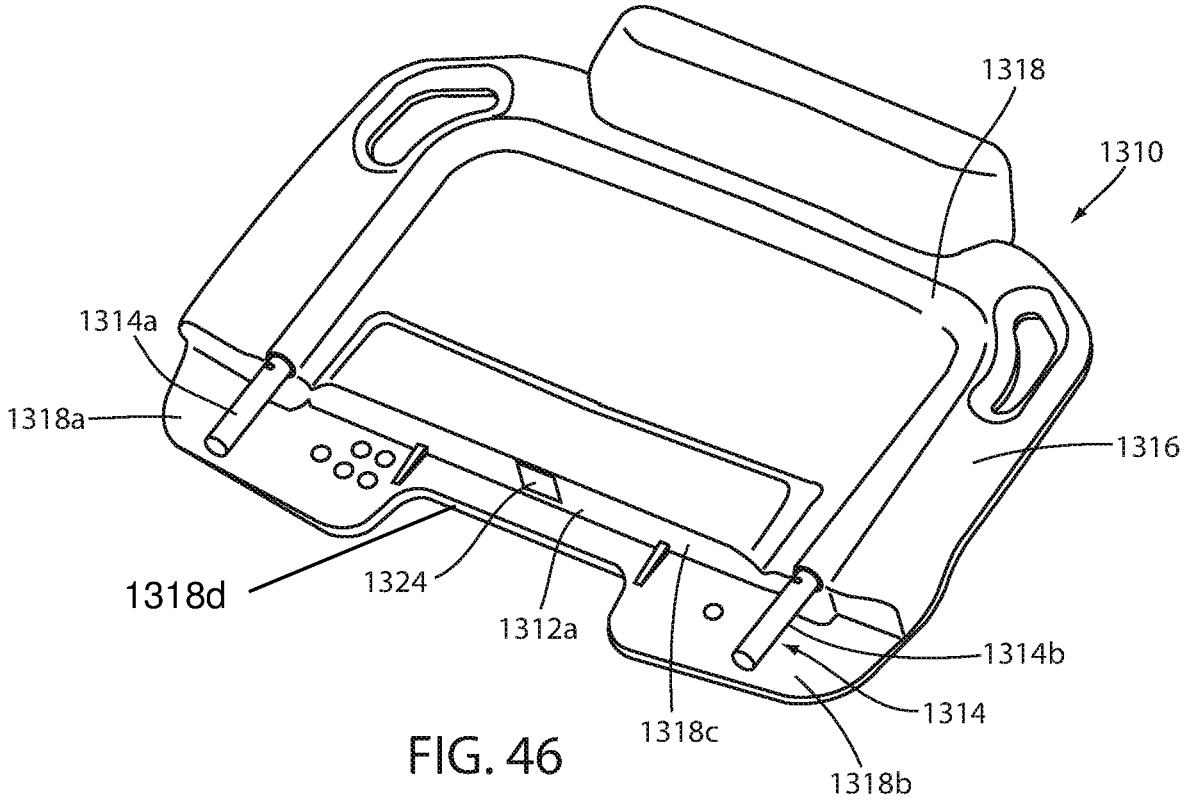
FIG. 46 is a bottom perspective view of the footboard removed from its footboard mounting base.
Figure 46A:
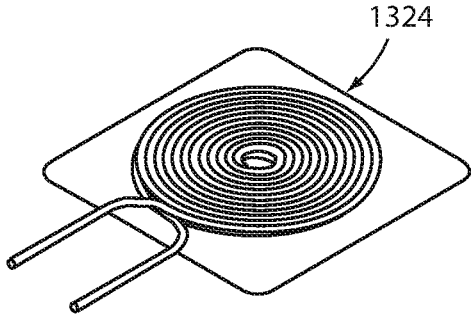
FIG. 46A is a perspective view of a coil which is mounted to the footboard.
Figure 46B:
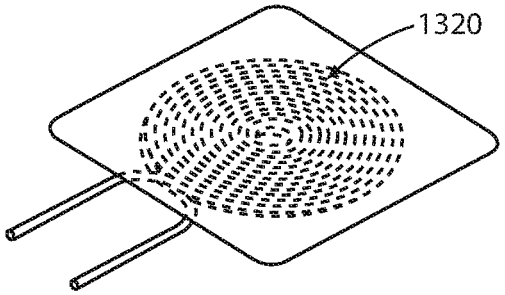
FIG. 46B is a perspective view of a coil which is mounted to the footboard of mounting base.

Referring to FIGS. 45 and 46, the numeral 1310 generally designates another embodiment of a footboard assembly. Footboard assembly 1310 includes a footboard 1312 that is removably mounted to a footboard mounting base 1313, which may form part of a bed frame or may be mounted to a bed frame. To removably mount footboard 1312 to footboard mounting base 1313, footboard 1312 includes a pair of posts 1314*a*, 1314*b* that extend into corresponding sockets 1316 formed on or provided in footboard mounting base 1313.

In the illustrated embodiment, footboard system 1310 includes an electrical interface connection between footboard 1312 and footboard mounting base 1313, which is accomplished without the use of mechanical interconnection between its electrical components. Instead, electrical connection is achieved using a wireless power transfer system 1311, illustrated in FIG. 46C. As best seen in FIGS. 45 and 46, each of the footboard and footboard mounting base 1312, 1313 includes an electrical inductive coil 1320 and 1324. Electrical inductive coil 1320 is mounted to the upwardly facing side 1313*a* of footboard mounting base 1313. Similarly, coil 1324 is mounted to a downwardly facing side 1312*a* of footboard 1312, and aligned with coil 1320 when footboard 1320 is mounted to footboard mounting base 1313 and posts 1314*a*, 1314*b* and aligned and inserted into sockets 1316.

In the illustrated embodiment, footboard 1312 includes a cover 1318 that is formed from a polymer material, such as an ABS plastic, that is molded over an inverted U-shaped frame member 1314 (e.g. metal tubular member) whose ends form posts 1314*a*, 1314*b*. Further, in the illustrated embodiment, footboard 1312 includes a control console 1330 that houses one or more electrical devices 1332, such as a display 1326, including a graphical user interface, such as a touch screen, a keyboard, iBed® Awareness lights sold by Stryker Corporation of Kalamazoo Mich., user input devices, such as buttons, including capacitive mechanical buttons, ports, such as DVT pump ports, USB ports, outlets or auxiliary ports, or the like. For further details of an iBed Awareness light, reference is made herein to U.S. Pat. No. 8,689,376 and U.S. patent application Ser. No. 13/035,544, filed on Feb. 25, 2011, which are commonly owned by Stryker Corporation of Kalamazoo, Mich. and incorporated by reference herein in their entireties. Reference is made to the previous embodiments for additional details on the optional electrical devices that may be mounted to footboard 1312.

Control console 1330 may comprise a separate housing that is mounted to footboard 1312, for example, pivotally mounted, or may be an integral housing that is formed as part of the footboard cover 1318. For an example of a separate control console, reference is made herein to U.S. Pat. Nos. 7,690,059; 7,805,784; 7,962,981; 7,861,334; and 7,779,493, which are commonly owned by Stryker Corp. and incorporated by reference herein their entireties.

In the illustrated embodiment, footboard cover 1318 includes two downwardly depending portions 1318*a*, 1318*b*, which extend over and downwardly in front of footboard mounting base 1313 (as viewed from the foot end of the bed) when footboard 1312 is mounted to footboard mounting base 1313, which facilitates guiding posts 1314*a*, 1314*b* into sockets 1316 and, further, hides the ends of footboard mounting base 1313. Cover 1318 also forms a shoulder 1318*c* upward of downwardly depending portions 1318*a*, 1318*b* (and of lower edge 1318*d* of cover 1318 (FIG. 46)) for resting on footboard mounting base 1313 and through which posts 1314*a*, 1314*b* extend. Additionally, shoulder 1318*c* forms downwardly facing side 1312*a* of footboard 1312 where receiving coil 1324 is mounted and through which receiving coil 1324 couples to the receiving circuit described below. Similarly, footboard mounting base 1313 includes a transverse beam 1319, which supports sockets 1316 for receiving post 1314*a*, 1314*b* and which forms upwardly facing side 1313*a* of footboard mounting base 1313 where transmitting coil 1320 is mounted and through which transmitting coil 1320 couples to the transmitting circuit described below. Transverse beam 1319 also provides a bearing surface for footboard 1312 to rest on when footboard is mounted to footboard mounting base 1313 to thus form a bearing interface surface with the shoulder 1318*c* of the footboard 1318.

Figure 46C:
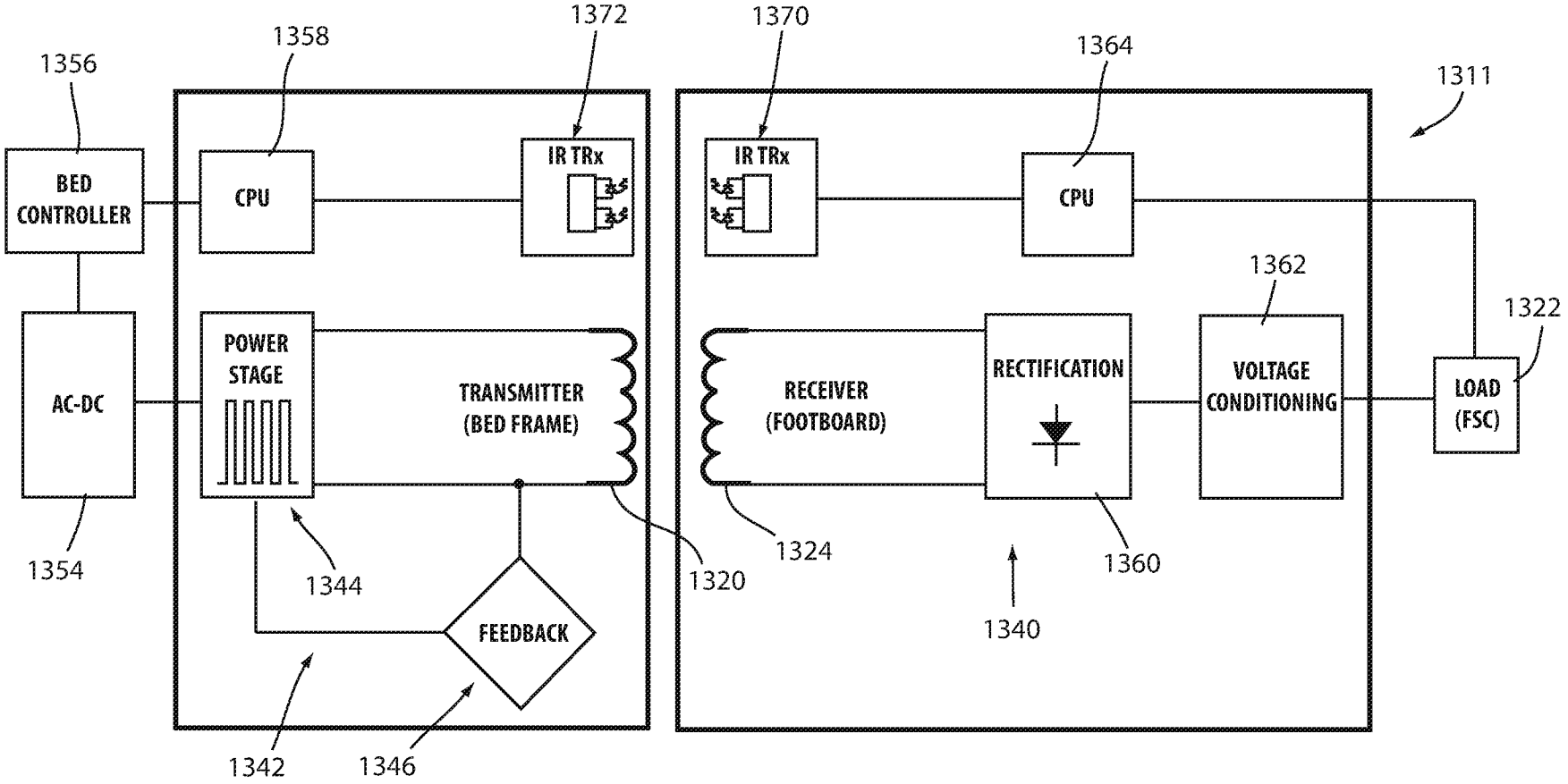
FIG. 46C is a schematic of the wireless power transfer circuit of the footboard of FIG. 45.

Referring to FIG. 46C, inductive coils 1320 and 1324 are connected to respective transmitting and receiving circuits 1340 and 1342. When an alternating current (or interrupted direct current) is passed through the transmitting coil from the transmitting circuit, the transmitting coil generates a magnetic field which induces voltage in the receiving coil which then can be used to power through the receiving circuit one or more of the electrical devices noted above.

Receiving circuit 1340 couples to the respective electrical device or devices within the footboard for powering the electrical device(s) when a voltage is generated across coil 1320. Similarly, transmitting circuit 1342 is coupled to the bed based power supply (1354), which includes a circuit for switching between a DC supply, namely the bed based battery, and an AC supply, namely a wall outlet power supply so that when the respective coils 1320 and 1324 are sufficiently close, electrical current flow through circuit 1342 will generate a voltage in coil 1320, which will induce a voltage and current flow in coil 1324 to thereby power the respective devices coupled to circuit 1340.

For example, referring to FIG. 46C, circuit 1342 includes a high frequency DC to AC converter 1344, which is coupled to the bed power supply 1354, which may be an AC supply or a DC battery. Converter 1344 converts the DC voltage or AC voltage into a high frequency AC voltage that is applied to transmitting coil 1320, which induces a voltage in coil 1324. Optionally, the wireless power transfer system 1311 comprises a dynamic wireless power transfer system that can adjust its impedance or duty cycle or other operating parameter as needed, for example to increase efficiency. Accordingly, transmitting circuit 1342 may include a feedback circuit 1346, which adjusts the output from converter 1344, to, for example, adjust the impedance of coil 1320, which can improve the efficiency of wireless power transfer system 1311.

The power from power supply 1354 to transmitting coil 1320 is regulated by a bed based controller 1356, which includes or is coupled to a central processing unit 1358, which also controls communication between one or more electrical devices 1332 at footboard and the bed based controller 1356.

Referring again to FIG. 46C, receiving circuit 1340 includes a rectification circuit 1360, such as a diode bridge, which converts the high frequency AC voltage from coil 1324 into a DC voltage suitable for driving the one of more electrical devices 1322. A voltage conditioning device 1362, such as an op amp, may also be provided to filter out any noise in the voltage to the electrical devices.

As understood by those skilled in the art, the efficiency of the power transfer depends on the coupling between the two coils. The coupling is determined by the distance between the two coils and the ratio of the diameters of the respective coil. Further, the coupling may be affected by the shape of the coils and the angle between them. In the illustrated embodiment, coils 1320 and 1324 are both helical and approximately the same size. However, it should be understood that their sizes and shape may vary.

In the illustrated embodiment, footboard 1312 and footboard mounting base 1313 may also each include optical couplers 1370 and 1372 for transmitting signals and/or data between the footboard 1312 and footboard mounting base 1313. Optical couplers 1370 and 1372 act as opto-transceivers and couple using an LED light wave emitter and a photosensor.

As best seen in FIG. 46C, optical coupler 1372 is coupled to CPU 1358, and optical coupler 1370 is coupled to a CPU 1364 of footboard mounting base 1313, which is in communication with electrical devices 1322. In this manner, bed based controller 1356 may communicate with CPU 1364 via optical couplers 1370 and 1372 to transmit or receive signals and/or data from CPU 1364. Thus, footboard 1312 and footboard mounting base 1313 provide electrical interface for both power and communication back to the bed based power supply and a communication bus network (not shown) located at the bed.

Alternately, footboard 1312 and footboard mounting base 1313 may each include a separate designated inductive coil or a transceiver (or transmitter and receiver) to transmit signals and/or data between footboard 1312 and footboard mounting base 1313.

In addition to providing wireless power supply, coils 1320, 1324 may also provide contactless or wireless communication, for example serial communication. This can be achieved by "piggybacking" on the wireless power to and from the induction coils. Serial communication can be established during wireless power transfer by superimposing a high frequency carrier signal onto the power supply frequency with conventional communication protocol. The system would therefore be a two-way transceiver system capable of isolating the high frequency carrier from the low end impedances on the power side.

Figure 46D:
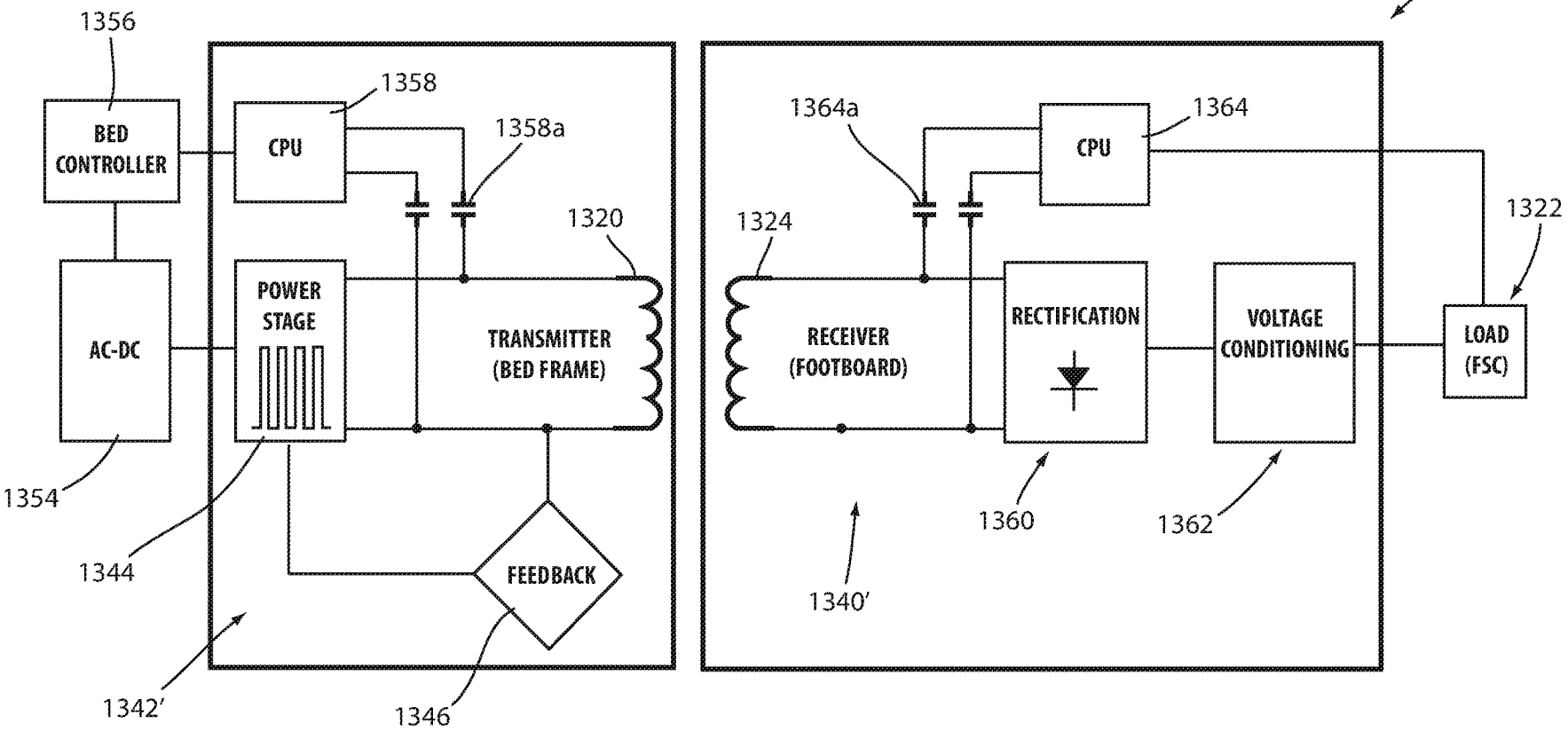
FIG. 46D is schematic of another embodiment of the wireless power transfer circuit of the footboard.
Figure 47:
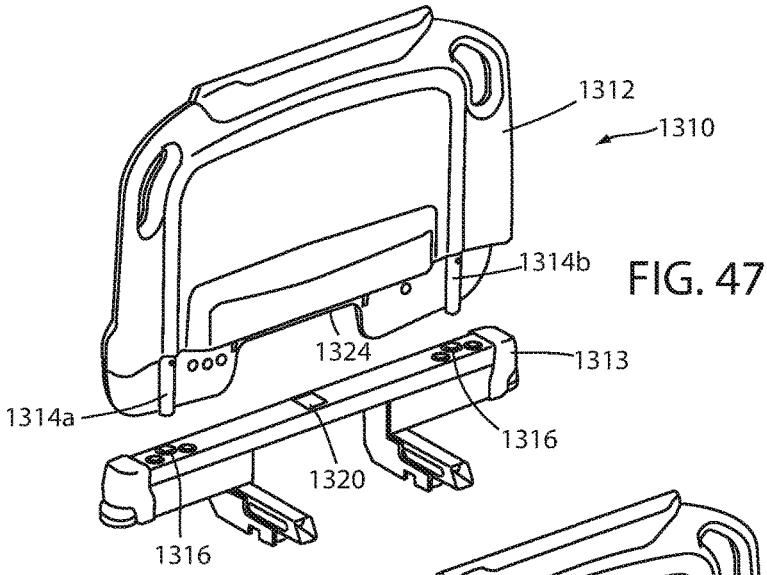
FIG. 47 is an exploded perspective view of the footboard assembly illustrating the footboard spaced from the footboard mounting base.
Figure 48:
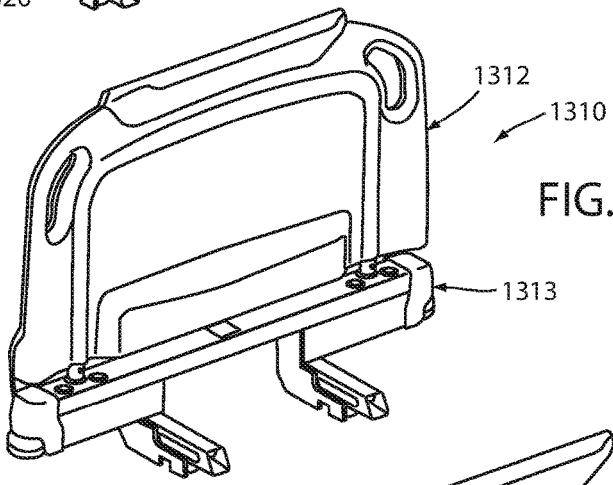
FIG. 48 is a similar view to FIG. 47 with the footboard moved closer to the mounting base.
Figure 49:
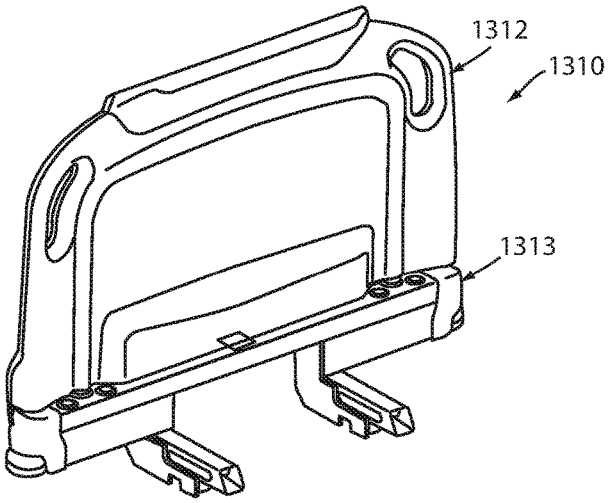
FIG. 49 is a similar view to FIG. 47 with the footboard moved closer to the mounting base where there is no gap between the respective coils of the wireless power transfer circuit.

Referring to FIG. 46D, footboard system 1311' may include a transmitting circuit 1342' similar to circuit 1342 and a receiving circuit 1340' but with CPU 1358 and CPU 1364 connected to the power lines from power converter 1344 and from coil 1324 via capacitors 1358*a*, 1364*a*, respectively, which superimpose a high frequency carrier signal onto the power supply frequency with an on/off modulation scheme acting as the 1's and 0's required for serial communication.

Wireless/contactless serial communication can also be achieved by implementing any one of a plurality of other wireless technologies adjacent or in parallel to the wireless induction-coil power while utilizing proprietary industry common communication protocols, such as NFC and radio-waves, and wireless, such as WiFi, Zigby, Bluetooth, etc.

Consequently, the wireless/contactless power and/or communication eliminates the need for (1) direct physical contact between induction-coil blind mate halves, (2) for physical electrical contact terminals (3) physical & mechanical alignment of blind mate halves. Further, the wireless/contactless power and/or communication reduces the number of required circuits and free conductors and the size of the electrical connections.

In addition, because the power and/or communication physical connections are eliminated, cleaning and hence infection-control results can be significantly improved.

Optionally, coils 1320 and 1324 can be positioned behind thin wall enclosures for complete protection against the elements and, further, are safe to touch.

As noted above, the induction coils can be of any number of shapes and profiles (i.e. round, rectangular, formed coil, pancake, spherical-helical, external or internal, meandering, etc.) and of any size. Further, the coils can either be separate stand-alone devices or printed circuit board (PCBA) mounted. For further details of a suitable wireless power supply system reference is made to U.S. Pat. No. 8,844,204, which is commonly owned by Stryker Corp. and incorporated by reference herein its entirety.

The 'contactless' blind mate connection is, therefore, capable of wirelessly providing power and bi-directional serial communication while providing all of the benefits of traditional breakaway style electrical connectors, but with many additional advantages and improvements as a result of the electrical interface requiring no physical contact between each half.

Various alterations and changes can be made to the above-described embodiments without departing from the broader aspects of the disclosure as defined in the appended claims, which are to be interpreted in accordance with the principles of patent law including the doctrine of equivalents. This disclosure is presented for illustrative purposes and should not be interpreted as an exhaustive description of all embodiments of the disclosure or to limit the scope of the claims to the specific elements illustrated or described in connection with these embodiments. For example, and without limitation, any individual element or group of elements of the described disclosure may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present disclosure is not limited to only those embodiments that include all of these features or that provide all of the stated benefits, except to the extent otherwise expressly set forth in the issued claims. Further, a feature or features of one embodiment may be incorporated or substituted for a feature or features of another embodiment. Any reference to claim elements in the singular, for example, using the articles "a," "an," "the" or "the," is not to be construed as limiting the element to the singular.

We claim:

1. A person support apparatus comprising:

a base;

a barrier having an electrical device and an electrical receiving circuit supported therein for powering said electrical device, said barrier configured to releasably mount to said base, and said electrical receiving circuit having a wireless power receiver;

a bed based power supply; and said base having a transmitting circuit coupled to said bed based power supply, said transmitting circuit including a wireless power transmitter to inductively couple and transfer electrical energy to said electrical receiving circuit when said wireless power receiver is in proximity to said wireless power transmitter, wherein said transmitting circuit is configured to adjust its impedance to improve the resonant frequency match between said electrical receiving circuit and said transmitting circuit.

2. The person support apparatus according to claim 1, wherein said base forms a bearing interface with said barrier, and said barrier extending below said wireless power receiver and below said bearing interface.

3. The person support apparatus according to claim 2, wherein said barrier includes a pair of downwardly depending portions, said pair of downwardly depending portions guiding said barrier onto said base.

4. The person support apparatus according to claim 3, wherein said barrier includes a pair of mounting structures mounting said barrier to said base.

5. The person support apparatus according to claim 4, wherein said base includes a pair of sockets, and said pair of mounting structures comprise a pair of posts for extending into said pair of sockets when said barrier is mounted to said base.

6. The person support apparatus according to claim 5, wherein said pair of posts are spaced from said pair of downwardly depending portions wherein said pair of downwardly depending portions guide said pair of posts into said pair of sockets.

7. The person support apparatus according to claim 3, said barrier includes a cover, said cover forming said pair of downwardly depending portions.

8. The person support apparatus according to claim 7, wherein said barrier includes an inverted U-shaped frame, said cover molded over an upper portion of said inverted U-shaped frame, and a lower portion of said inverted U-shaped frame extending from said cover to form a pair of mounting structures for mounting said barrier on said base.

9. The person support apparatus according to claim 8, wherein said cover forms a shoulder adjacent said pair of downwardly depending portions, and said lower portion of said inverted U-shaped frame extending from said cover.

10. The person support apparatus according to claim 9, wherein said wireless power receiver is mounted at said shoulder between said pair of mounting structures.

11. The person support apparatus according to claim 1, wherein said wireless power receiver and said wireless power transmitter each comprise an inductive coil.

12. The person support apparatus according to claim 1, wherein said transmitting circuit is configured to adjust the impedance of the wireless power transmitter.

13. The person support apparatus according to claim 1, wherein said transmitting circuit includes a circuit for switching between said bed based power supply and an AC supply.

* * * * *